US009839985B1

(12) United States Patent
Lessway

(10) Patent No.: US 9,839,985 B1
(45) Date of Patent: Dec. 12, 2017

(54) FIXTURE ASSEMBLY

(71) Applicant: Arobotech Systems, Inc., Madison Heights, MI (US)

(72) Inventor: Richard Lessway, Bloomfield Hills, MI (US)

(73) Assignee: Arobotech Systems, Inc., Madison Heights, MI (US)

( * ) Notice: Subject to any disclaimer, the term of this patent is extended or adjusted under 35 U.S.C. 154(b) by 0 days.

(21) Appl. No.: 15/455,511

(22) Filed: Mar. 10, 2017

(51) Int. Cl.
*B25B 1/00* (2006.01)
*B24B 3/24* (2006.01)
*B25B 1/20* (2006.01)

(52) U.S. Cl.
CPC ..... *B24B 3/247* (2013.01); *B25B 1/20* (2013.01)

(58) Field of Classification Search
CPC .... B25B 1/00; B25B 1/02; B25B 1/10; B25B 1/18; B25B 5/061; B25B 11/00; B25B 11/1102
See application file for complete search history.

(56) References Cited

U.S. PATENT DOCUMENTS

| | | | |
|---|---|---|---|
| 1,213,574 | A | 1/1917 | Baash |
| 1,961,091 | A | 5/1934 | Smith et al. |
| 2,160,378 | A | 5/1939 | Balsiger |
| 3,145,513 | A | 8/1964 | Porath |
| 3,234,829 | A | 2/1966 | Dinsmore |
| 3,320,839 | A | 5/1967 | Dinsmore |
| 3,330,074 | A | 7/1967 | Stuckey |
| 3,427,762 | A | 2/1969 | Mills |
| 3,535,963 | A | 10/1970 | Dietl |
| 3,736,114 | A | 5/1973 | Okada |
| 4,195,448 | A | 4/1980 | Check et al. |
| 4,205,492 | A | 6/1980 | Matsuura et al. |
| 4,276,723 | A | 7/1981 | Fournier |
| 4,399,639 | A | 8/1983 | Lessway |
| 4,518,187 | A | 5/1985 | Blatt et al. |
| 4,519,279 | A | 5/1985 | Ruggeri |
| 4,647,097 | A | 3/1987 | Lessway |
| 4,647,100 | A | 3/1987 | Lessway |
| 4,650,237 | A | 3/1987 | Lessway |
| 5,058,468 | A | 10/1991 | Lessway |

(Continued)

FOREIGN PATENT DOCUMENTS

| | | | |
|---|---|---|---|
| EP | 0529218 | A1 | 3/1993 |
| EP | 0562180 | A1 | 9/1993 |
| EP | 0602366 | A1 | 6/1994 |

*Primary Examiner* — Lee D Wilson
(74) *Attorney, Agent, or Firm* — Harness, Dickey & Pierce, P.L.C.

(57) ABSTRACT

A fixture assembly may include a housing, a clamp assembly, and a drive mechanism. The clamp assembly may be movably mounted to the housing and may include a first clamp member and a second clamp member. The first and second clamp members may be linearly movable relative to the housing toward and away from each other. The drive mechanism may be coupled to the clamp assembly and the housing and may drive the clamp assembly relative to the housing such that the first clamp member moves linearly toward the second clamp member at a first speed in a first direction and the second clamp member moves linearly toward the first clamp member at a second speed in a second direction that is opposite the first direction. The first speed may be different than the second speed.

20 Claims, 18 Drawing Sheets

(56) References Cited

U.S. PATENT DOCUMENTS

| | | | | |
|---|---|---|---|---|
| 5,237,780 | A | 8/1993 | Lessway | |
| 5,285,599 | A | 2/1994 | Lessway | |
| 6,699,113 | B2 | 3/2004 | Lessway | |
| 7,293,765 | B2 * | 11/2007 | Hooper | B25B 1/103 269/246 |
| 7,331,093 | B2 * | 2/2008 | Ferrari | B23B 31/16216 269/225 |
| 7,566,061 | B2 | 7/2009 | Townsend | |
| 7,597,035 | B2 | 10/2009 | Rehm | |
| 8,246,027 | B2 * | 8/2012 | Li | B25J 15/026 269/225 |
| 8,251,374 | B2 | 8/2012 | Bronzino et al. | |
| 8,266,992 | B2 | 9/2012 | Rehm | |
| 8,413,971 | B2 * | 4/2013 | Kim | B08B 7/02 269/228 |
| 8,726,772 | B2 | 5/2014 | Helm et al. | |
| 8,770,564 | B2 * | 7/2014 | Bass | B23C 3/355 269/43 |
| 9,174,317 | B1 | 11/2015 | Lessway | |
| 2011/0260416 | A1 | 10/2011 | Helm | |
| 2012/0119452 | A1 | 5/2012 | Blaser et al. | |
| 2012/0255407 | A1 | 10/2012 | Maurer et al. | |
| 2012/0260779 | A1 | 10/2012 | Maurer et al. | |
| 2012/0326402 | A1 * | 12/2012 | Grob | B23Q 1/0009 279/134 |
| 2013/0047804 | A1 | 2/2013 | Maurer et al. | |
| 2013/0056941 | A1 | 3/2013 | Helm | |
| 2014/0001712 | A1 | 1/2014 | Helm et al. | |
| 2016/0082572 | A1 * | 3/2016 | Rattunde | B23D 45/12 269/43 |

* cited by examiner

FIXTURE ASSEMBLY

FIELD

The present disclosure relates to a fixture assembly, and more particularly, to a fixture assembly for holding a tool for a tool-sharpening operation.

BACKGROUND

This section provides background information related to the present disclosure and is not necessarily prior art.

Fixtures are commonly used for securing a workpiece during a machining operation. For example, a fixture may be used to hold a drill bit to sharpen the tip of the drill bit. Conventional fixtures for holding drill bits for sharpening operations must be realigned relative to a sharpening tool for drill bits having different diameters. That is, if drill bits of different diameters are to be sharpened, an operator must realign a conventional fixture relative to the sharpening tool for each drill bit diameter. Such repeated realignment of the fixture consumes substantial amounts of time, which substantially increases costs associated with sharpening numerous drill bits of a variety of different diameters.

The present disclosure provides a fixture that can hold drill bits (or other workpieces) of various diameters without having to realign the fixture relative to the sharpening tool for each diameter. That is, the fixture of the present disclosure can hold a drill bit having a first diameter for a sharpening operation before and/or after holding another drill bit having a second diameter for a sharpening operation without having to realign the fixture relative to the sharpening tool to account for the difference between the first and second diameters. Such capability can save substantial amounts of time, money and resources for a user that is sharpening many drill bits of various diameters.

SUMMARY

This section provides a general summary of the disclosure, and is not a comprehensive disclosure of its full scope or all of its features.

The present disclosure provides a fixture assembly that may include a housing, a clamp assembly, and a drive mechanism. The clamp assembly may be movably mounted to the housing and may include a first clamp member and a second clamp member. The first and second clamp members may be linearly movable relative to the housing toward and away from each other. The drive mechanism may be coupled to the clamp assembly and the housing and may drive the clamp assembly relative to the housing such that the first clamp member moves linearly toward the second clamp member at a first speed in a first direction and the second clamp member moves linearly toward the first clamp member at a second speed in a second direction that is opposite the first direction. The first speed may be different than the second speed.

In some configurations, the drive mechanism includes a central plate that engages the first and second clamp members. The central plate may be received in the housing and may be slidable within the housing in a third direction that is perpendicular to the first and second directions.

In some configurations, the central plate includes a first side having a first clamp slot formed therein and a second side having a second clamp slot formed therein. The first and second sides may be opposite each other. The first clamp member may be slidably received in the first clamp slot and the second clamp member may be slidably received in the second clamp slot.

In some configurations, the first and second clamp slots are disposed at acute angles relative to the third direction.

In some configurations, the first clamp slot is disposed at a first acute angle relative to the third direction, and the second clamp slot is disposed at a second acute angle relative to the third direction. The first acute angle may be different than the second acute angle.

In some configurations, the housing includes a first guide slot and a second guide slot. The first guide slot may slidably receive a first slider block attached to the first clamp member. The second guide slot may slidably receive a second slider block attached to the second clamp member. The first slider block may move within the second guide slot in the first direction as the central plate moves in the third direction. The second slider block may move within the second guide slot in the second direction as the central plate moves in the third direction.

In some configurations, the first clamp member includes a first flat gripping surface and a second flat gripping surface that is angled relative to the first flat gripping surface. The first and second flat gripping surfaces may both engage a workpiece (e.g., a drill bit or other tool) and cooperate with the second clamp member to fix the workpiece relative to the housing.

In some configurations, an angle between the first flat gripping surface and the second direction is equal to the first angle. An angle between the second flat gripping surface and the second direction may be equal to the first angle. The second angle may be less than the first angle.

In some configurations, the second clamp member includes cylindrical rod having a longitudinal axis that is perpendicular to the third direction.

In some configurations, the first clamp member includes a first clamp arm and a first clamp block. The first clamp arm may be slidably received in the first clamp slot in the central plate. The first clamp block may be mounted to an end of the first clamp arm and may be pivotable relative to the first clamp arm about a first rotational axis that is parallel to the third direction. The first and second flat gripping surfaces may be mounted on the first clamp block.

In some configurations, the second clamp member includes a second clamp arm and a second clamp block. The second clamp arm may be slidably received in the second clamp slot in the central plate. The second clamp block may be mounted to an end of the second clamp arm and may be pivotable relative to the second clamp arm about a second rotational axis that is parallel to the third direction. The cylindrical rod may be mounted on the second clamp block.

In some configurations, the first and second flat gripping surfaces are defined by first and second wear pads, respectively, that are mounted to the first clamp block. Edges of the first wear pad may be clamped to fix the first wear pad to the first clamp block, and edges of the second wear pad may be clamped to fix the second wear pad to the first clamp block.

The present disclosure also provides a fixture assembly that may include a base (or housing), a clamp assembly, and a drive mechanism. The clamp assembly is movably mounted on the base and includes a first clamp member and a second clamp member. The first and second clamp members may be linearly movable relative to the base toward and away from each other. The drive mechanism is coupled to the clamp assembly and drives the clamp assembly relative to the base. The drive mechanism may include a first link attached to the first clamp member and a second link attached to the second clamp member. The first and second links may be coupled to each other such that linear movement of the first link at a first speed and in a first direction causes corresponding linear movement of the second link at a second speed and in a second direction that is opposite the first direction. The first speed is different than the second speed.

In some configurations, the first clamp member includes a first flat gripping surface and a second flat gripping surface that is angled relative to the first flat gripping surface. The first and second flat gripping surfaces may simultaneously engage a workpiece (for example, a tool such as a drill bit) and cooperate with the second clamp member to fix the workpiece relative to the base.

In some configurations, the second clamp member includes cylindrical rod having a longitudinal axis that is parallel with an intersection of planes defined by the first and second flat gripping surfaces.

In some configurations, the first and second links are parallel to each other and move linearly relative to each other along parallel paths of motion.

In some configurations, the first and second clamp members are movable in the first and second directions along a common track.

In some configurations, each of the first and second clamp members includes a slider block, a gripping block, an adjuster block, and a resiliently flexible plate. The gripping block may be mounted to the slider block and may include a cavity and a first slot that is open to (i.e., extends through to) the cavity. The adjuster block may be mounted to the slider block and may be disposed at least partially within the cavity. The adjuster block may include a second slot. The resiliently flexible plate is received in the first slot of the gripping block and the second slot of the adjuster block. Clearances between the adjuster block and walls of the gripping block that define the cavity may allow for relative lateral movement between the gripping block and the adjuster block. The resiliently flexible plate may resist the relative lateral movement between the gripping block and the adjuster block and bias the gripping block toward a nominal position relative to the adjuster block.

In some configurations, the relative lateral movement between the gripping block and the adjuster block bends the resiliently flexible plate about an axis that is perpendicular to the first and second directions of the linear movement of the first and second links.

In some configurations, each of the first and second clamp members includes a post that extends from the slider block and slidably engages the adjuster block to allow for movement of the adjuster block and the gripping block relative to the slider block along a length of the post in a direction that is perpendicular to the first and second directions of the linear movement of the first and second links.

In some configurations, the fixture assembly includes a threaded fastener engaging the adjuster block. The threaded fastener is rotatable relative to the adjuster block in one direction to fix the adjuster block relative to the post and in another direction to allow movement of the adjuster block along the length of the post.

In some configurations, the first link engages the slider block of the first clamp member, and the second link engages the slider block of the second clamp member.

The present disclosure also provides a method of clamping a first tool and a second tool in a fixture assembly. The fixture assembly may include a housing, a first clamp member and a second clamp member. The first and second tools may have different outer diameters. The method may include simultaneously driving the first and second clamp members relative to the housing and toward each other to clamp the first tool therebetween such that a centerline of the first tool is disposed at a given location relative to the housing; unclamping the first tool; and simultaneously driving the first and second clamp members relative to the housing and toward each other to clamp the second tool therebetween such that a centerline of the second tool is disposed at the given location relative to the housing.

In some configurations, the first clamp member is disposed a first distance from the given location while the first tool is clamped between the first and second clamp members, and the second clamp member is disposed a second distance from the given location while the first tool is clamped between the first and second clamp members. The first clamp member is disposed a third distance from the given location while the second tool is clamped between the first and second clamp members, and the second clamp member is disposed a fourth distance from the given location while the second tool is clamped between the first and second clamp members. A difference between the third and first distances is different than a difference between the fourth and second distances.

In some configurations, simultaneously driving the first and second clamp members toward each other includes driving the first clamp member at a first speed while simultaneously driving the second clamp member at a second speed that is different from the first speed.

In some configurations, simultaneously driving the first and second clamp members toward each other includes driving the first and second clamp members in opposite linear directions.

In some configurations, simultaneously driving the first and second clamp members toward each other includes moving a plate within the housing in a direction perpendicular to the directions in which the first and second clamp members move toward each other.

In some configurations, the plate includes a first clamp slot that slidably receives the first clamp and a second clamp slot that slidably receives the second clamp.

In some configurations, the first clamp slot is disposed at a first acute angle relative to the direction in which the plate moves within the housing, and the second clamp slot is disposed at a second acute angle relative to the direction in which the plate moves within the housing. The first acute angle is different than the second acute angle.

In some configurations, the method includes adjusting positions of the first and second clamp members relative to the base in a direction perpendicular to the opposite linear directions. The positions of the first and second clamp members can be adjusted relative to the base in this manner independently of each other.

In some configurations, the method includes adjusting an angle between the first and second clamp members.

In some configurations, spring members resist adjustment of the angle between the first and second clamp members.

In some configurations, the first clamp member includes first and second gripping surfaces that are disposed at an angle relative to each other. Clamping the first tool may include contacting the first tool with the first and second gripping surfaces. Clamping the second tool may include contacting the second tool with the first and second gripping surfaces.

In some configurations, the second clamp member includes a cylindrical rod that is parallel with an intersection of the first and second gripping surfaces. Clamping the first tool may include contacting the first tool with the cylindrical rod. Clamping the second tool may include contacting the second tool with the cylindrical rod.

In some configurations, the method includes adjusting an angle between a longitudinal axis of the cylindrical rod and an intersection of planes defining the first and second flat gripping surfaces.

In some configurations, the first and second tools are drill bits.

In some configurations, clamping the first tool includes contacting the drill bit at only three locations (e.g., the first clamp member contacts the first tool at two locations, and the second clamp member contacts the first tool at only one location).

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
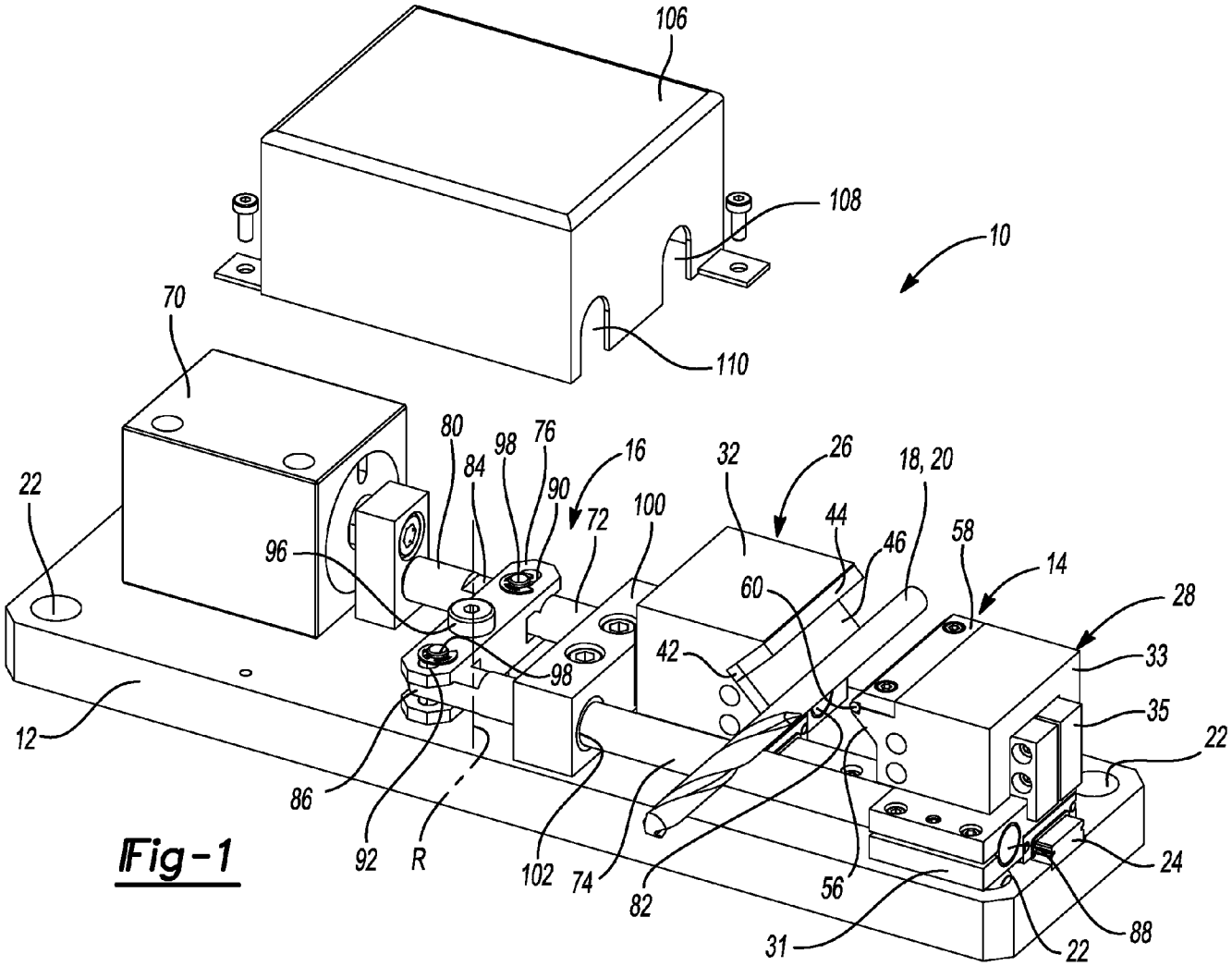
FIG. 1 is a perspective view of another fixture assembly according to the principles of the present disclosure with a cover removed to more clearly depict certain aspects of the fixture assembly.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-8, a fixture assembly 10 is provided that can hold tools (e.g., drill bits) or workpieces of different diameters without having to realign the fixture assembly 10 relative to a drill-bit-sharpening tool (not show) for each drill bit diameter. That is, the fixture assembly 10 can clamp a first drill bit 18 having a first diameter for a sharpening operation before and/or after clamping a second drill bit 20 (FIG. 6) having a second diameter that is different than the first diameter for a drill bit sharpening operation without having to realign the fixture assembly 10 relative to the sharpening tool to account for the difference between the first and second diameters. Such capability can save substantial amounts of time, money and resources for a user that is sharpening many drill bits of various diameters.

The fixture assembly 10 may include a base (or housing) 12, a clamp assembly 14, and a drive mechanism 16. The base 12 may be a rigid plate having a plurality of mounting apertures 22 for mounting the fixture assembly 10 to a machining apparatus such as a drill-bit-sharpening tool, for example.

The clamp assembly 14 may include a track 24, a first clamp member 26, and a second clamp member 28. The track 24 may be fixedly mounted to the base 12. The first and second clamp members 26, 28 are slidable along the track 24 relative to the base 12 and each other. As will be described in more detail below, the first and second clamp members 26, 28 are slidable along the track 24 in opposite directions (toward and away from each other) at different speeds.

Figure 2:
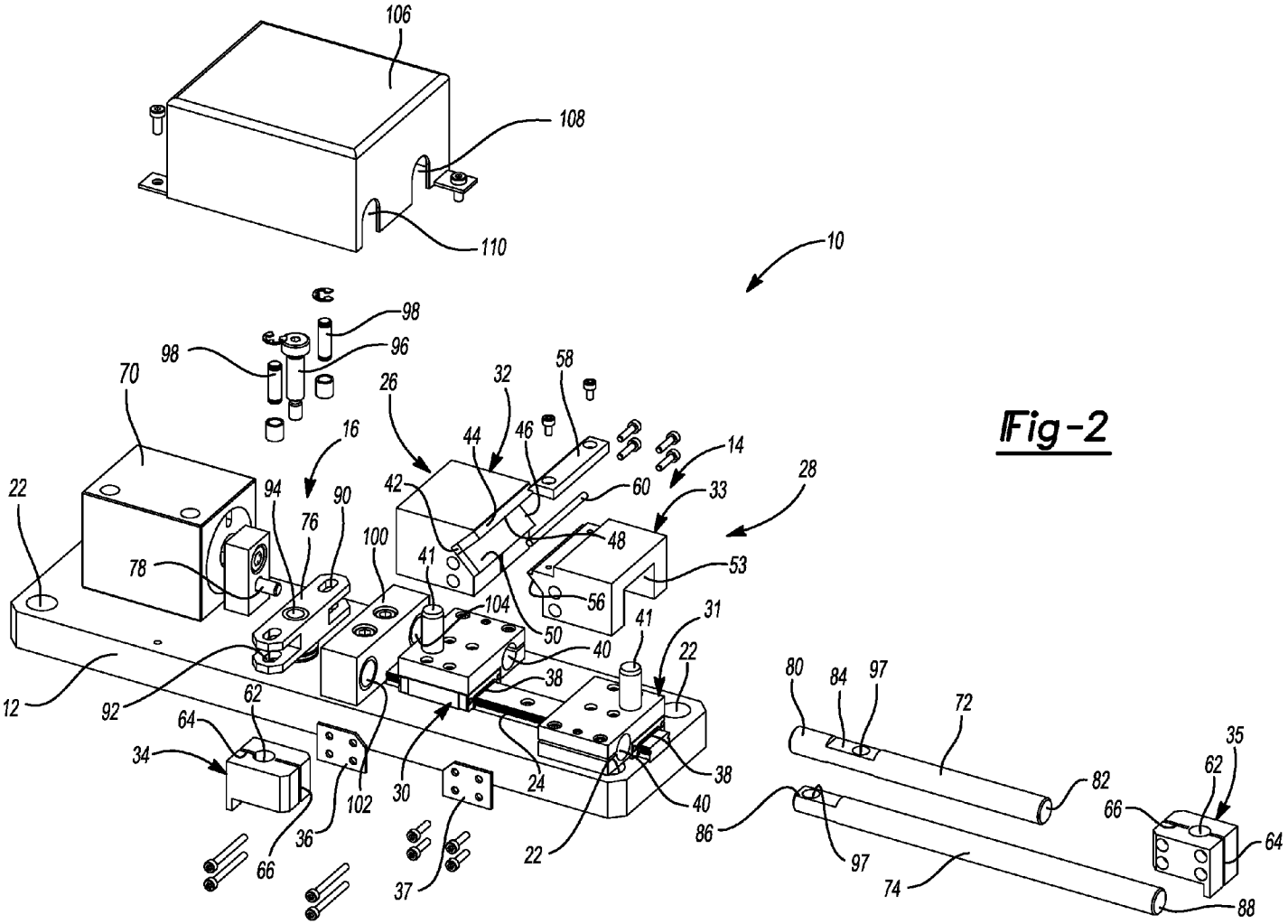
FIG. 2 is a partially exploded view of the fixture assembly of FIG. 11.

As shown in FIG. 2, the first and second clamp members 26, 28 may include first and second slider blocks 30, 31, first and second gripping blocks 32, 33, first and second adjuster blocks 34, 35, and first and second spring members (e.g., resiliently flexible plates) 36, 37, respectively. The first and second slider blocks 30, 31 may each include a channel 38 that slidably receives the track 24. In some configurations, ball bearings (not shown) can be attached to the slider blocks 30, 31 within the channel 38 to facilitate smooth slidable motion of the slider blocks 30, 31 along the track 24. Each of the slider blocks 30, 31 may include an aperture 40 extending at least partially therethrough in a direction parallel to a longitudinal axis of the track 24. The aperture 40 of the first slider block 30 may be laterally offset from the track 24 in a first direction, and the aperture 40 of the second slider block 31 may be laterally offset from the track 24 in a second direction that is opposite the first direction. In other words, the track 24 is disposed laterally between the apertures 40 of the first and second slider blocks 30, 31. Each of the slider blocks 30, 31 may also include a post 41 that extends upward (when viewed from the frame of reference of FIG. 2) therefrom.

The first gripping block 32 is mounted to the first slider block 30 and may include a generally V-shaped recess 42. The V-shaped recess 42 may extend laterally through the first gripping block 32 in a direction perpendicular to the longitudinal axis of the track 24 (i.e., perpendicular to the directions along which the first and second clamp members 26, 28 slide along the track 24). First and second gripping pads 44, 46 may be mounted to the first gripping block 32 within the V-shaped recess 42. The gripping pads 44, 46 can be hard, flat blocks that define first and second gripping surfaces 48, 50, respectively, that both contact the drill bit 18, 20 when the clamp assembly 14 is clamping the drill bit 18, 20.

Figure 5:
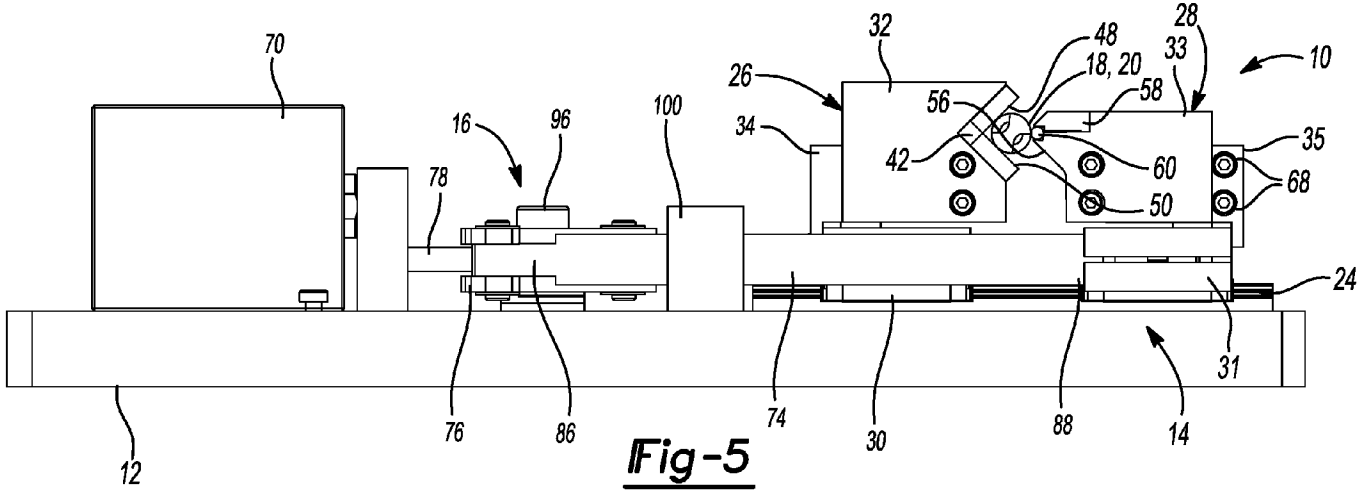
FIG. 5 is a side view of the drill bit and the fixture assembly in a clamped position.

As shown in FIG. 5, the gripping surfaces 48, 50 are angled relative to each other. In some configurations, the angle between the gripping surfaces 48, 50 is 90 degrees. Each gripping surface 48, 50 may be angled 45 degrees (i.e., half of the angle between the gripping surfaces 48, 50) relative to a horizontal plane that is parallel to the directions in which the first and second clamp members 26, 28 slide along the track 24. It will be appreciated that the angle between the gripping surfaces 48, 50 may be more or less than 90 degrees, and the angle between the horizontal plane and the gripping surfaces 48, 50 may be more or less than 45 degrees.

The first gripping block 32 may also include a first cavity 52 (FIGS. 7 and 8) and a first slot 54 (FIG. 7) that is open to (i.e., extends through to) the first cavity 52. The first adjuster block 34 may be at least partially disposed within the first cavity 52. The first spring member 36 may be at least partially disposed within the first slot 54.

Figure 6:
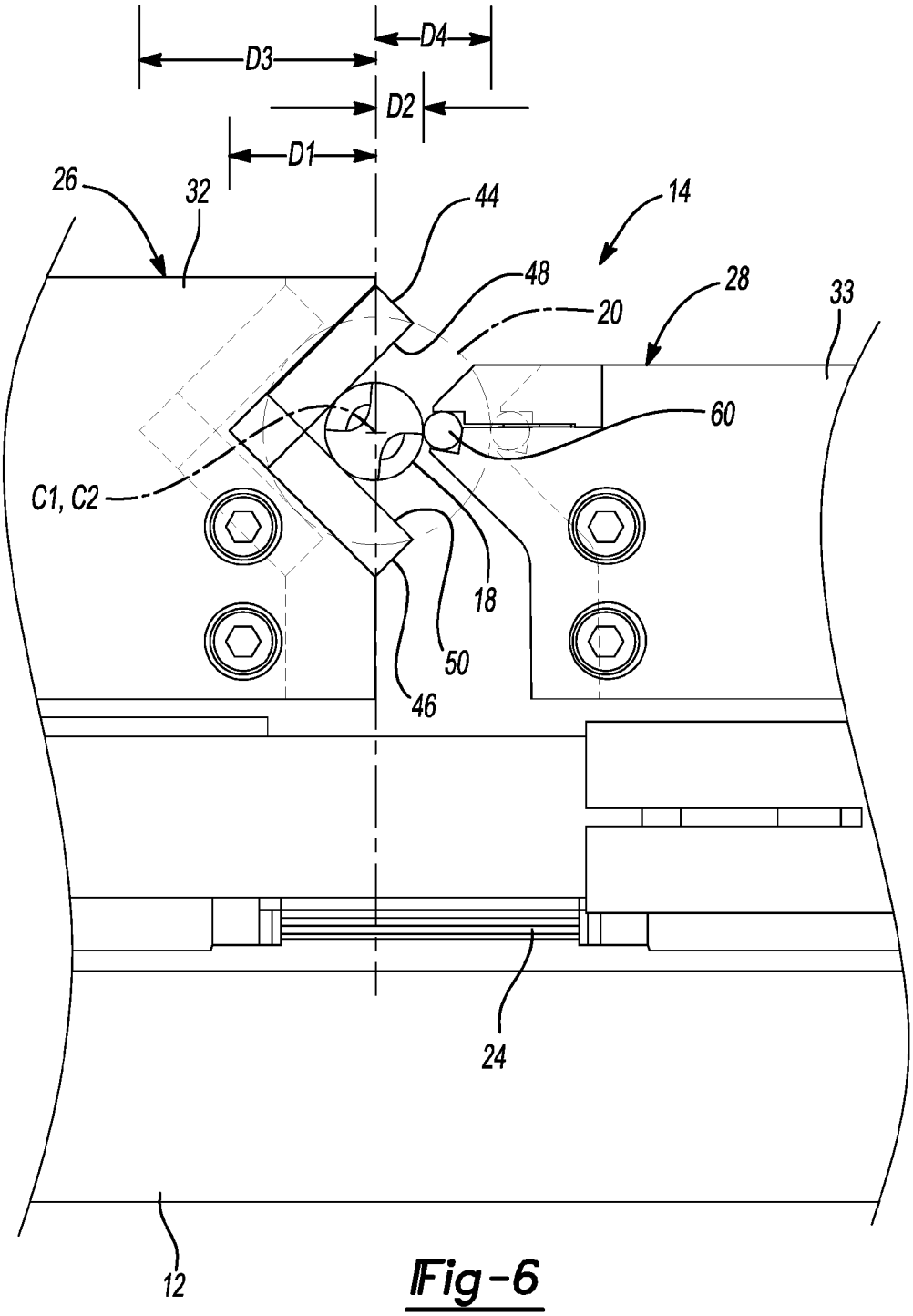
FIG. 6 is a partial side view of the fixture assembly clamping a first drill bit (shown in solid lines) and clamping a second drill bit (shown in phantom lines)
Figure 7:
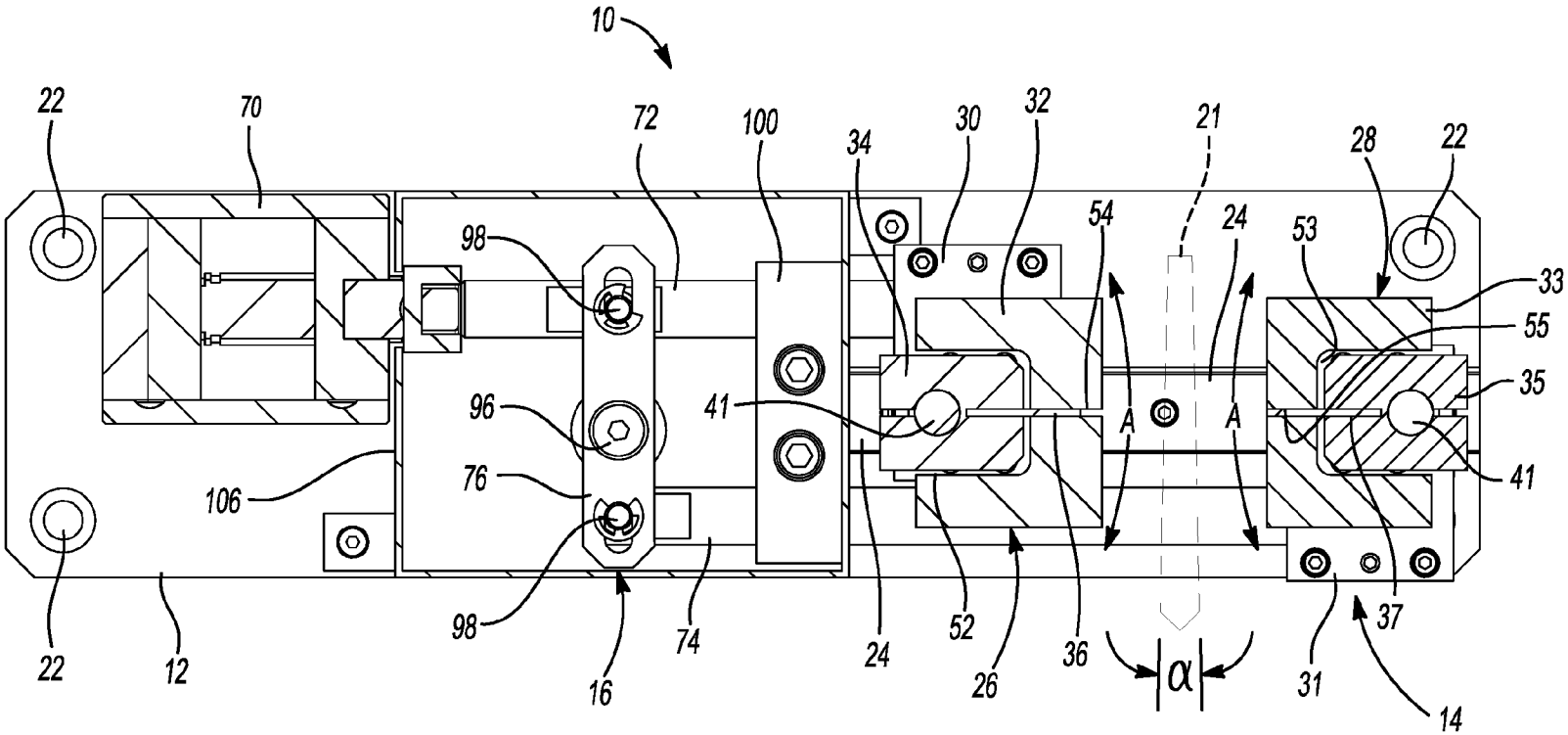
FIG. 7 is a cross-sectional view of the fixture assembly.
Figure 8:
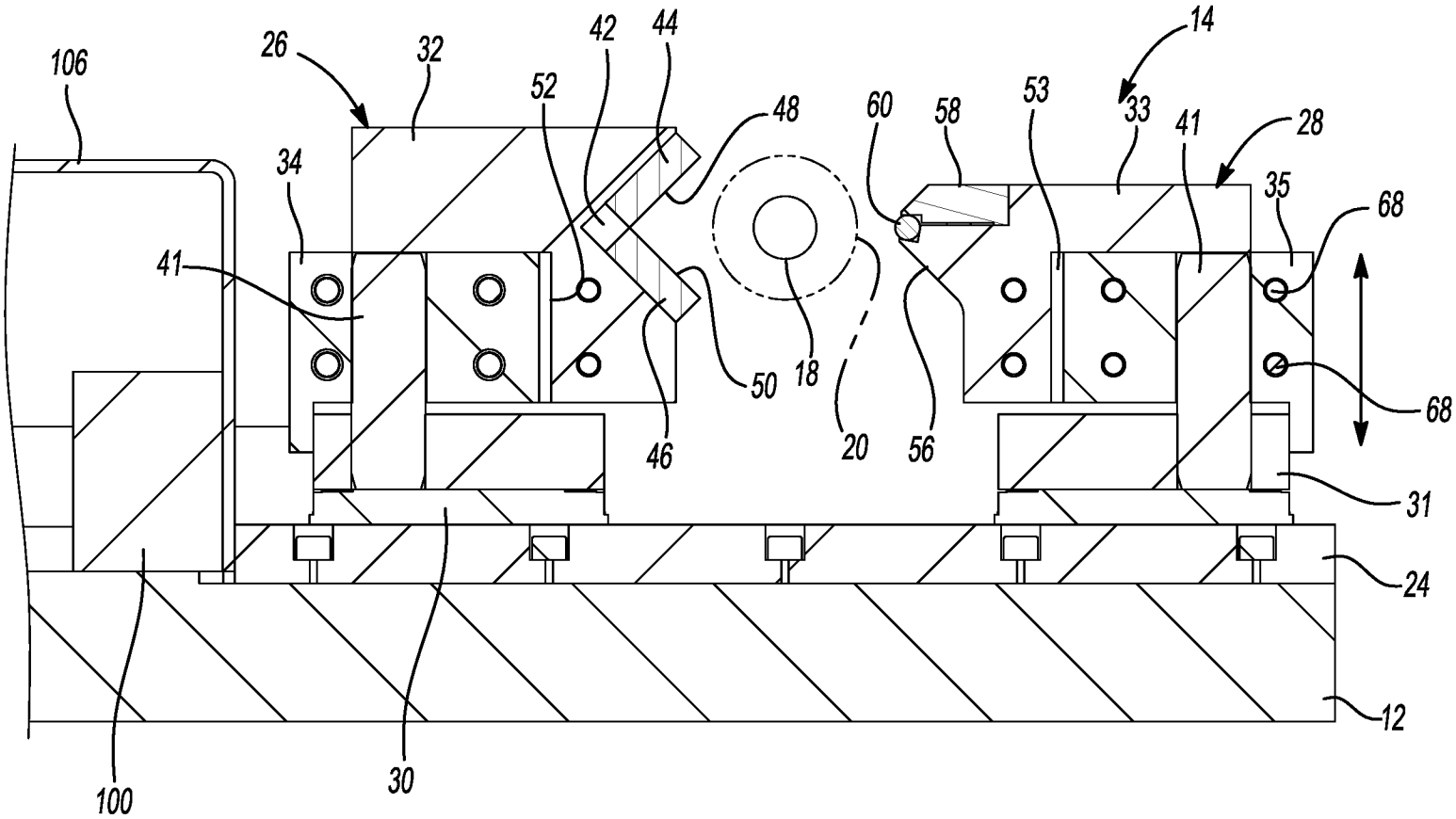
FIG. 8 is a cross-sectional view of a portion of the fixture assembly.

As shown in FIGS. 7 and 8, the second gripping block 33 is mounted to the second slider block 31 and may include a protrusion 56, a second cavity 53, and a second slot 55 that is open to (i.e., extends through to) the second cavity 53. The protrusion 56 may extend generally toward the first gripping block 32 and may cooperate with a plate 58 to fixedly engage a hardened cylindrical wear pad (e.g., a cylindrical rod) 60. A longitudinal axis of the cylindrical wear pad 60 may be parallel to and aligned with an intersection of planes defined by the first and second gripping surfaces 48, 50 of the first gripping block 32. As shown in FIGS. 5 and 6, the cylindrical wear pad 60 and the first and second gripping surfaces 48, 50 contact the outer diameter of the drill bit 18, 20 to hold the drill bit 18, 20 in place when the clamp assembly 14 is in the clamped position.

The first and second adjuster blocks 34, 35 may be mounted to the first and second slider blocks 30, 31, respectively, and may be at least partially received within the cavities 53 of the first and second gripping blocks 32, 33, respectively. Each of the first and second adjuster blocks 34, 35 may include an aperture 62, a clamping slot 64, and a spring slot 66. The posts 41 of the first and second slider blocks 30, 31 may be movably received within the apertures 62 of the first and second adjuster blocks 34, 35, respectively.

The clamping slot 64 extends through three sides of the adjuster block 34, 35 and into the aperture 62. Threaded fasteners 68 (FIG. 5) extend through the clamping slot 64 and engage the adjuster block 34, 35 on both sides of the clamping slot 64. The threaded fasteners 68 can be threadably tightened and loosened to contract and expand the aperture 62 to tighten and loosen the fit of the adjuster block 34, 35 on the post 41. When the fit of the adjuster block 34, 35 on the post is loosened, the position of the adjuster block 34, 35 (and thus, the gripping block 32, 33) along the length of the post 41 can be adjusted, as shown in FIG. 8. When the fit of the adjuster block 34, 35 on the post is tightened, the position of the adjuster block 34, 35 (and thus, the gripping block 32, 33) along the length of the post 41 is fixed.

The spring slots 66 of the first and second adjuster blocks 34, 35 may receive the first and second spring members 36, 37, respectively. In some configurations, fasteners may engage the adjuster blocks 34, 35 and the spring members 36, 37 to fix an end of each spring member 36, 37 relative to the corresponding adjuster block 34, 35.

With the first spring member 36 received within the spring slot 66 of the first adjuster block 34 and within the slot 54 of the first gripping block 32, the resilient flexibility of the first spring member 36 allows the first gripping block 32 to move laterally and/or pivot about an axis that is perpendicular to directions of linear movement of the first and second clamp members 26, 28 along the track 24 and parallel to the longitudinal axis of the post 41. Similarly, with the second spring member 37 received within the spring slot 66 of the second adjuster block 35 and within the slot 54 of the second gripping block 33, the resilient flexibility of the second spring member 37 allows the second gripping block 33 to move laterally and/or pivot about an axis that is perpendicular to directions of linear movement of the first and second clamp members 26, 28 along the track 24 and parallel to the longitudinal axis of the post 41. In this manner, an angle between the first and second gripping blocks 32, 33 can be adjusted to accommodate a tapered drill bit shaft 21 (having a taper angle $\alpha$), as indicated by arrows A in FIG. 7. The spring members 36, 37 bias the gripping blocks 32, 33 toward a nominal position in which the gripping blocks 32, 33 are parallel to each other (e.g., to accommodate a constant diameter drill bit shaft).

As shown in FIGS. 1-4, the drive mechanism 16 may include an actuator 70, a first link 72, a second link 74, and a lever 76. The actuator 70 can be any type of actuator, including an electric motor, a hydraulic actuator, a pneumatic actuator (e.g., using a compressed air source), or a manual spring-loaded toggle switch, for example.

The first and second links 72, 74 may be elongated generally cylindrical rods, for example. A first end 80 of the first link 72 may engage an output shaft 78 (FIG. 2) of the actuator 70, and a second end 82 of the first link 72 may be attached to the first slider block 30 (e.g., clamped or otherwise fixedly received within the aperture 40 of the first slider block 30). An intermediate portion 84 of the first link 72 may be slidably and pivotably coupled to the lever 76. A first end 86 of the second link 74 may be slidably and pivotably coupled to the lever 76, and a second end 88 of the second link 74 may be attached to the second slider block 31 (e.g., clamped or otherwise fixedly received within the aperture 40 of the second slider block 31).

As shown in FIG. 2, the lever 76 may include a first slot 90 extending through one end of the lever 76 and a second slot 92 extending through the other end of the lever 76. An aperture 94 may extend through the lever 76 at a location between the first and second slots 90, 92. A lever pivot pin 96 may extend through the aperture 94 and engage the base 12 to allow the lever 76 to rotate relative to the base 12. The lever 76 is rotatable relative to the base 12 about a rotational axis R (FIGS. 1, 3, and 4) that is defined by the lever pivot pin 96 and the aperture 94. The aperture 94 (and thus, the rotational axis R of the lever 76) may be located closer to the second slot 92 and the second link 74 than the first slot 90 and the first link 72. In other words, the aperture 94 (and thus, the rotational axis R of the lever 76) may be off-center relative to a longitudinal center point of the lever 76.

Figure 3:
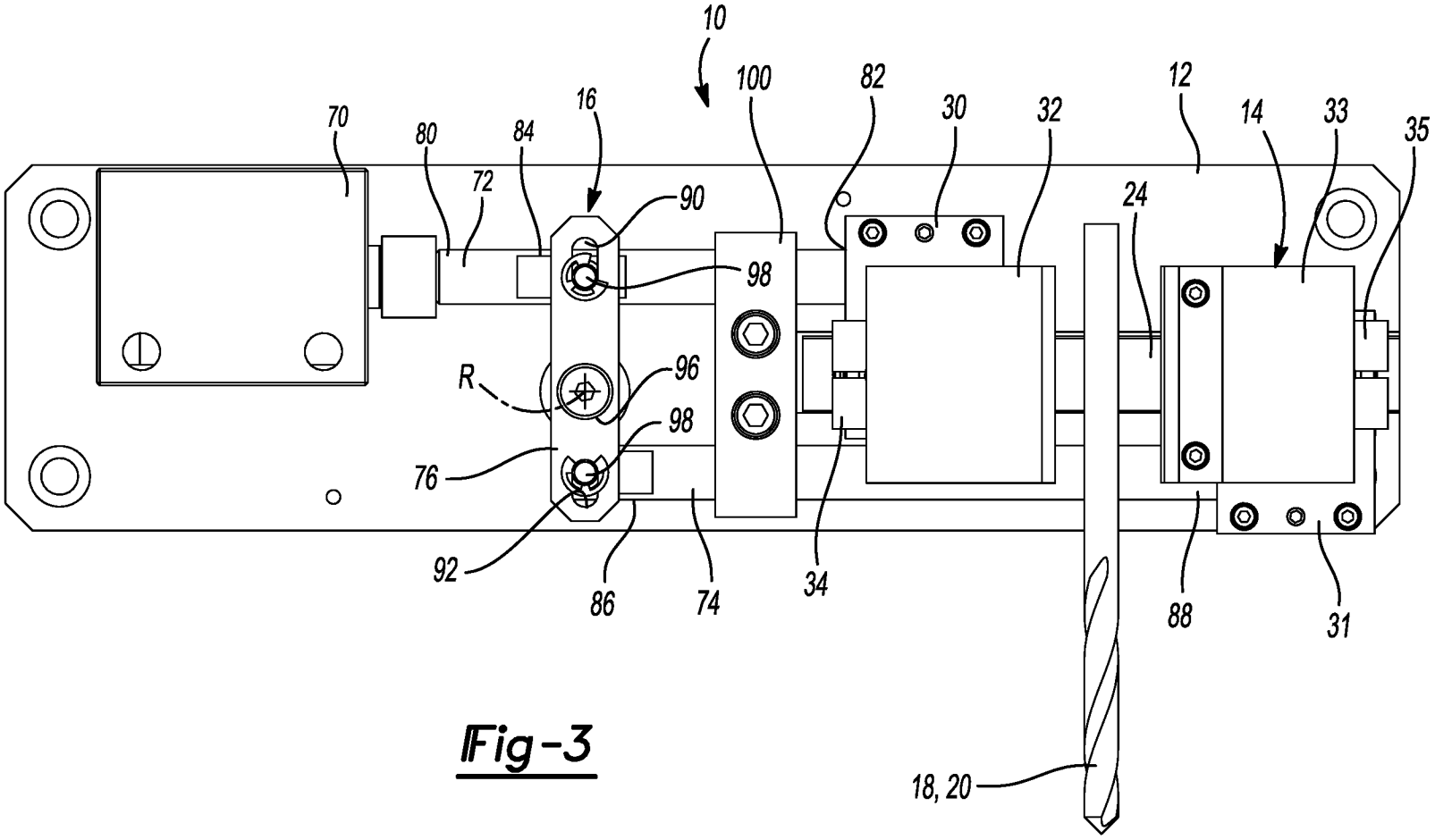
FIG. 3 is a plan view of a drill bit and the fixture assembly in an unclamped position.
Figure 4:
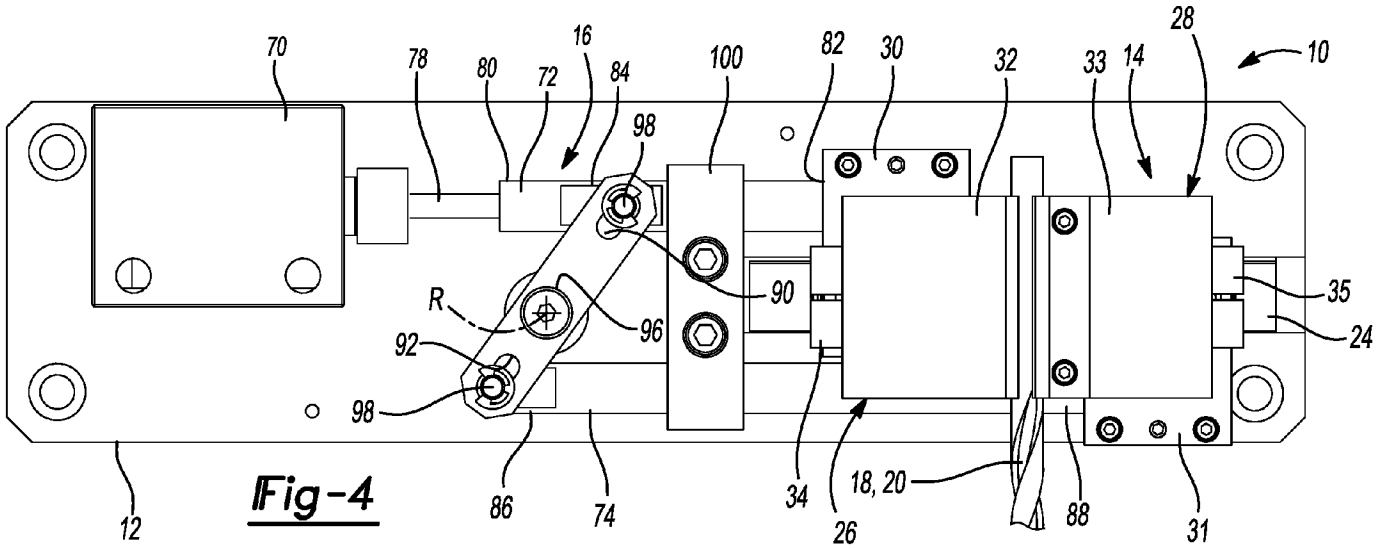
FIG. 4 is a plan view of the drill bit and the fixture assembly in a clamped position.

The intermediate portion 84 of the first link 72 and the first end 86 of the second link 74 may each include an aperture 97 (FIG. 2) extending therethrough. Link pivot pins 98 may extend through the apertures 97 and corresponding ones of the first and second slots 90, 92 to rotatably couple the first and second links 72, 74 to the lever 76. The first and second slots 90, 92 slide along the link pivot pins 98 as the lever 76 rotates relative to the base 12 about the lever pivot pin 96, as shown in FIGS. 3 and 4.

A guide block 100 may be fixedly mounted to the base 12 and may include first and second apertures 102, 104 (FIG. 2) that slidably receive the first and second links 72, 74, respectively. The apertures 102, 104 in the guide block 100 extend longitudinally parallel to the length of the track 24 such that the guide block 100 supports the first and second links 72, 74 and guides the motion of the first and second links 72, 74 in linear directions parallel to the length of the track 24.

In some configurations, a cover 106 (FIGS. 1, 2 and 7) may be mounted to the base 12 to protect portions of the drive mechanism 16 from damage. The cover 106 may be disposed over the lever 76, the guide block 100, and portions of the first and second links 72, 74. The first and second links 72, 74 may be movable through apertures 108, 110 in the cover 106.

In operation, the actuator 70 can be selectively actuated by a user to move the clamp assembly 14 between an unclamped position (FIG. 3) relative to the drill but 18, 20 and a clamped position (FIG. 4) relative to the drill bit 18, 20 (in which the first and second clamp members 26, 28 clamp the drill bit 18, 20 in place). To move the clamp assembly 14 from the unclamped position to the clamped position, the actuator 70 may be operated to cause linear movement of the first link 72 in a first direction (i.e., to the right when viewed from the frame of reference of FIG. 3) parallel to the length of the track 24. Such movement of the first link 72 moves the first clamp member 26 linearly along the track 24 in the first direction (i.e., toward the second clamp member 28) and causes the lever 76 to rotate about rotational axis R (i.e., in a clockwise direction when viewed from the frame of reference of FIG. 3). Such rotation of the lever 76 causes the second link 74 to move linearly in a second direction that is opposite the first direction, thereby moving the second clamp member 28 linearly along the track 24 in the second direction (i.e., toward the first clamp member 26).

Because the rotational axis R is located closer to the second link 74 than the first link 72, linear movement of the first link 72 at a first speed results in the linear movement of the second link 74 at a second speed that is slower than the first speed. That is, operation of the actuator 70 causes movement of the first link 72 and the first clamp member 26 in one linear direction along the track 24 at a first speed and movement of the second link 74 and the second clamp member 28 in the opposite direction along the track 24 at a second speed that is slower than the first speed.

The positioning of the rotational axis R along the length of the lever 76 determines the difference between the first and second speeds (positioning the rotational axis R closer to the longitudinal center of the lever 76 decreases the difference between the first and second speeds, and positioning the rotational axis R further from the longitudinal center of the lever 76 increases the difference between the first and second speeds). The positioning of the rotational axis R may be selected to achieve a predetermined difference or a predetermined proportionality between the first and second speeds. The predetermined difference or proportionality between the first and second speeds will cause the first and second clamp members 26, 28 to clamp the first drill bit 18 at a location such that a longitudinal center C1 of the first drill bit 18 is positioned at a predetermined location relative to the base 12 and will also cause the first and second clamp members 26, 28 to clamp the second drill bit 20 (which has a diameter that is larger than a diameter of the first drill bit 18) a location such that a longitudinal center C2 of the second drill bit 20 is also positioned at the same predetermined location relative to the base 12, as shown in FIG. 6. In other words, the predetermined difference or proportionality between the first and second speeds will cause the first and second clamp members 26, 28 to clamp any drill bit having any size diameter at the same predetermined location relative to the base 12 without making any adjustments to the positions of the gripping surfaces 48, 50 relative to the first slider block 30 or any adjustments of the position of the cylindrical wear pad 60 relative to the second slider block 31.

The first and second clamp members 26, 28 move at different speeds because they move different distances to clamp a drill bit at the predetermined location relative to the base 12. As shown in FIG. 6, when the first drill bit 18 is clamped in the clamp assembly 14, a given point on the first clamp member 26 is disposed at a first distance D1 from the center C1 of the first drill bit 18 (the center C1 is at the predetermined location relative to the base 12) and a given point on the second clamp member 28 is disposed a second distance D2 from the center C1. When the second drill bit 20 is clamped in the clamp assembly 14, the given point on the first clamp member 26 is disposed at a third distance D3 from the center C2 of the second drill bit 20 (the center C2 is at the predetermined location relative to the base 12) and the given point on the second clamp member 28 is disposed a fourth distance D4 from the center C2. The difference between the third and first distances D3, D1 is greater than the difference between the fourth and second distances D4, D2. Therefore, the drive mechanism 16 moves the first clamp member 26 at a faster speed than the second clamp member 28 so that the first and second clamp members 26, 28 will both come into contact with the outer diameter of the drill bit at the same time and at locations at which the center of the drill bit will be at the predetermined location relative the base 12, regardless of the size of the diameter of the drill bit.

The ability of the fixture assembly 10 to clamp any drill bit having any size diameter at the same predetermined location relative to the base 12 eliminates the need for a user to realign the fixture assembly 10 relative to a drill bit sharpening tool for drill bits of different diameters. Such capability can save substantial amounts of time, money and resources for a user that is sharpening many drill bits of various diameters.

Figure 9:
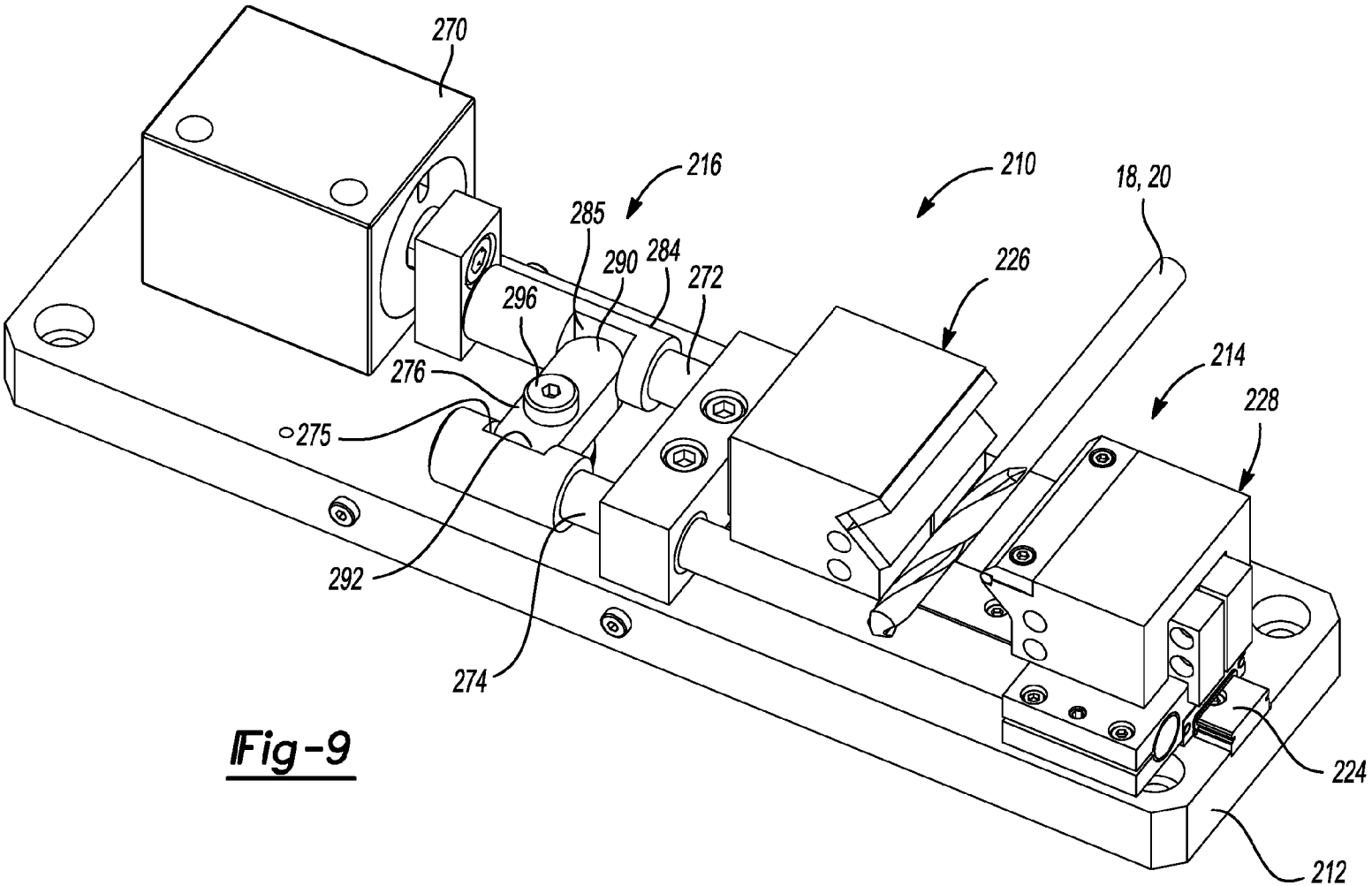
FIG. 9 is a perspective view of another fixture assembly according to the principles of the present disclosure.

With reference to FIG. 9, another fixture assembly 210 is provided that may include a base (or housing) 212, a clamp assembly 214, and a drive mechanism 216. The structure and function of the base 212 and the clamp assembly 214 may be similar or identical to that of the base 12 and the clamp assembly 14 described above, and therefore, will not be described again in detail.

The drive mechanism 216 may include an actuator 270, a first link 272, a second link 274, and a lever 276. The structure and function of the actuator 270 can be similar or identical to that of the actuator 70. Like the first link 72, one end of the first link 272 may engage an output shaft of the actuator 270 and the other end of the first link 272 may engage a slider block of a first clamp member 226 of the clamp assembly 214. An intermediate portion 284 of the first link 272 may include a slot 285 that slidably and pivotably engages a first end 290 of the lever 276. One end of the second link 274 may include a slot 275 that slidably and pivotably engages a second end 292 of the lever 276. The other end of the second link 274 may engage a slider block of a second clamp member 228 of the clamp assembly 214. The lever 276 also includes an aperture (like the aperture 94 described above) through which a pivot pin 296 extends. The pivot pin 296 engages the base 212 and defines a rotational axis (like the rotational axis R described above) about which the lever 276 is rotatable.

In a similar manner as described above, the actuator 270 may be operated to cause linear movement of the first link 272 in a first direction parallel to the length of a track 224 mounted to the base 212. Such movement of the first link 272 moves the first clamp member 226 linearly along the track 224 in the first direction and causes the lever 276 to rotate about rotational axis defined by the pivot pin 296. Such rotation of the lever 276 causes the second link 274 to move linearly in a second direction that is opposite the first direction, thereby moving the second clamp member 228 linearly along the track 224 in the second direction. Because the rotational axis defined by the pivot pin 296 is disposed closer to the second end 292 of the lever 276 than the first end 290 of the lever 276, linear movement of the first link 272 at a first speed results in linear movement of the second link 274 at a second speed that is slower than the first speed. In this manner, operation of the drive mechanism 216 results in movement of the clamp assembly 214 in substantially the same manner as operation of the drive mechanism 16 causes movement of the clamp assembly 14, as described above. Accordingly, like the fixture assembly 10, the fixture assembly 210 can clamp drill bits of various diameters at the same predetermined location relative to the base 212, as described above.

Figure 10:
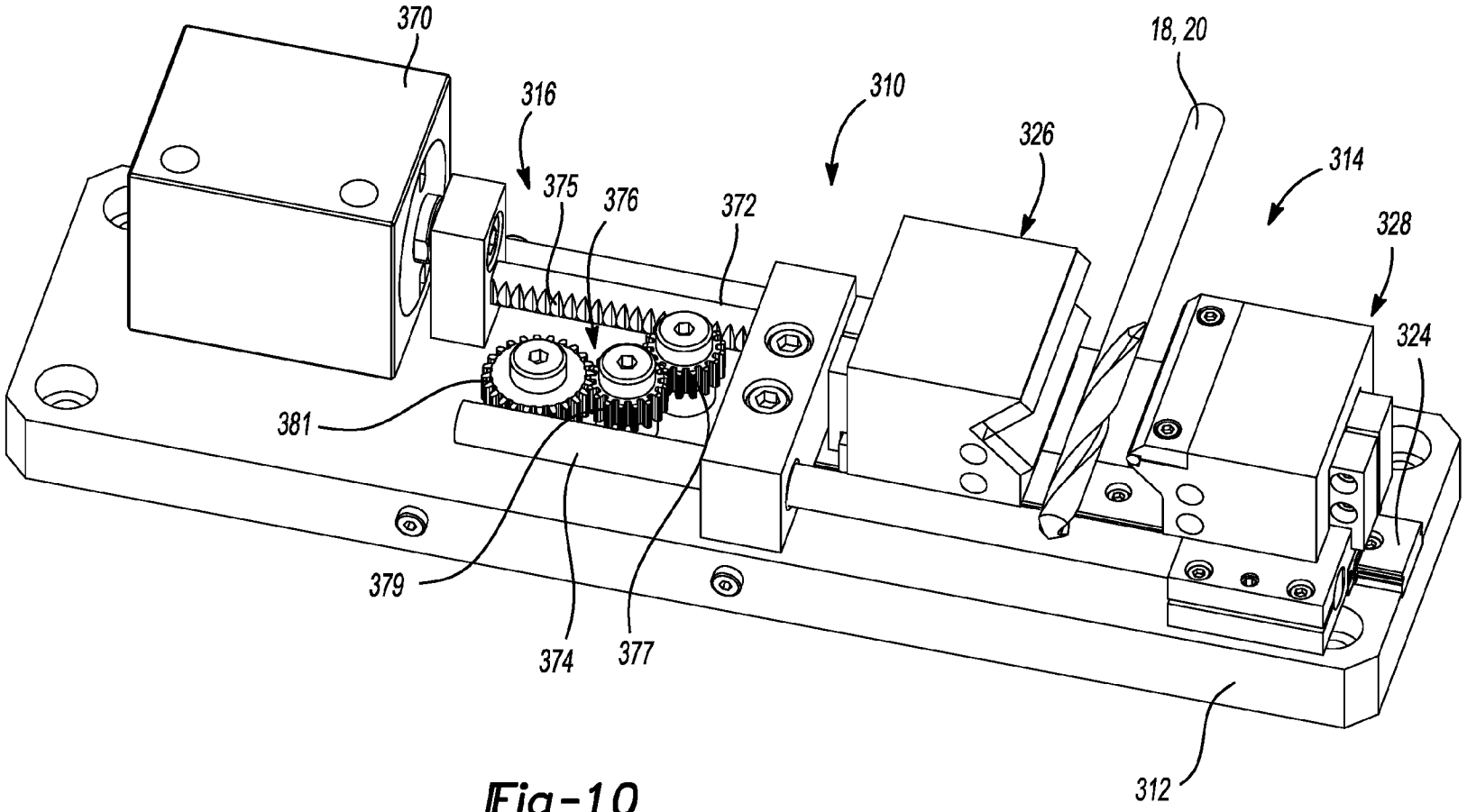
FIG. 10 is a perspective view of yet another fixture assembly according to the principles of the present disclosure.

With reference to FIG. 10, another fixture assembly 310 is provided that may include a base (or housing) 312, a clamp assembly 314, and a drive mechanism 316. The structure and function of the base 312 and the clamp assembly 314 may be similar or identical to that of the base 12 and the clamp assembly 14 described above, and therefore, will not be described again in detail.

The drive mechanism 316 may include an actuator 370, a first link 372, a second link 374, and a gear set 376 disposed between the first and second links 372, 374. The structure and function of the actuator 370 can be similar or identical to that of the actuator 70. Like the first link 72, one end of the first link 372 may engage an output shaft of the actuator 370 and the other end of the first link 372 may engage a slider block of a first clamp member 326 of the clamp assembly 314. One end of the second link 374 may engage a slider block of a second clamp member 328 of the clamp assembly 314. The first and second links 372, 374 both include a linear arrangement of gear teeth 375 spanning at least a portion of the lengths of the first and second links 372, 374.

The gear set 376 may include a first gear 377, a second gear 379, and a third gear 381. The first, second and third gears 377, 379, 381 are rotatably mounted to the base 312. The first gear 377 meshingly engages the gear teeth 375 of the first link 372 and meshingly engages the second gear 379. The third gear 381 meshingly engages the gear teeth 375 of the second link 374 and meshingly engages the second gear 379. The third gear 381 may have a larger diameter than the first and second gears 377, 379.

The actuator 370 may be operated to cause linear movement of the first link 372 in a first direction parallel to the length of a track 324 mounted to the base 312. Such movement of the first link 372 moves the first clamp member 326 linearly along the track 324 in the first direction and causes rotation of the first gear 377. Such rotation of the first gear 377 is transmitted to the second and third gears 379, 381, which causes the second link 374 to move linearly in a second direction that is opposite the first direction, thereby moving the second clamp member 328 linearly along the track 324 in the second direction. Because the third gear 381 has a larger diameter than the first and second gears 377, 379, linear movement of the first link 372 at a first speed results in linear movement of the second link 374 at a second speed that is slower than the first speed. In this manner, operation of the drive mechanism 316 results in movement of the clamp assembly 314 in substantially the same manner as the movement of the clamp assembly 14 described above. Accordingly, like the fixture assembly 10, the fixture assembly 310 can clamp drill bits of various diameters at the same predetermined location relative to the base 312, as described above.

Figure 11:
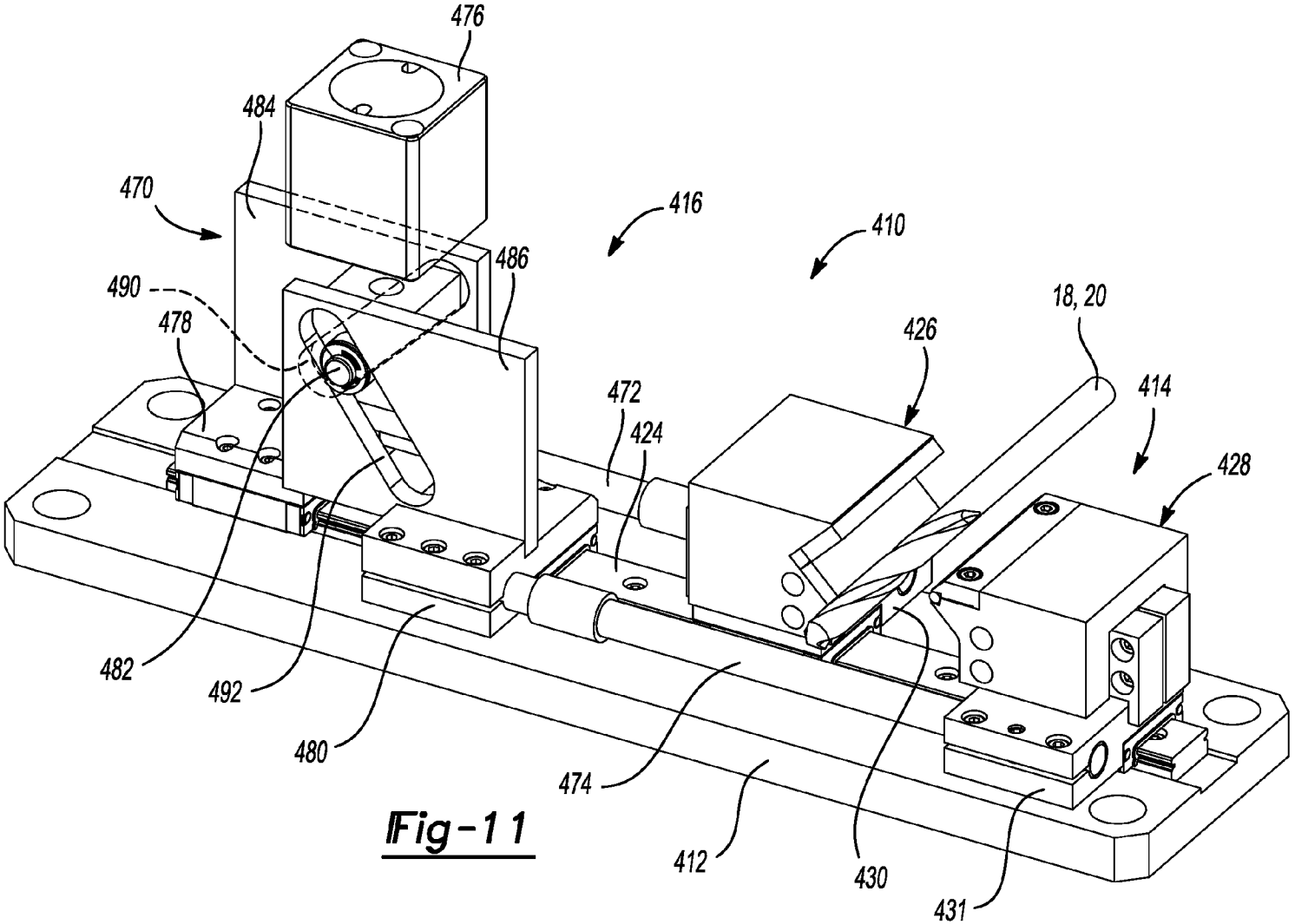
FIG. 11 is a perspective view of yet another fixture assembly according to the principles of the present disclosure.
Figure 12:
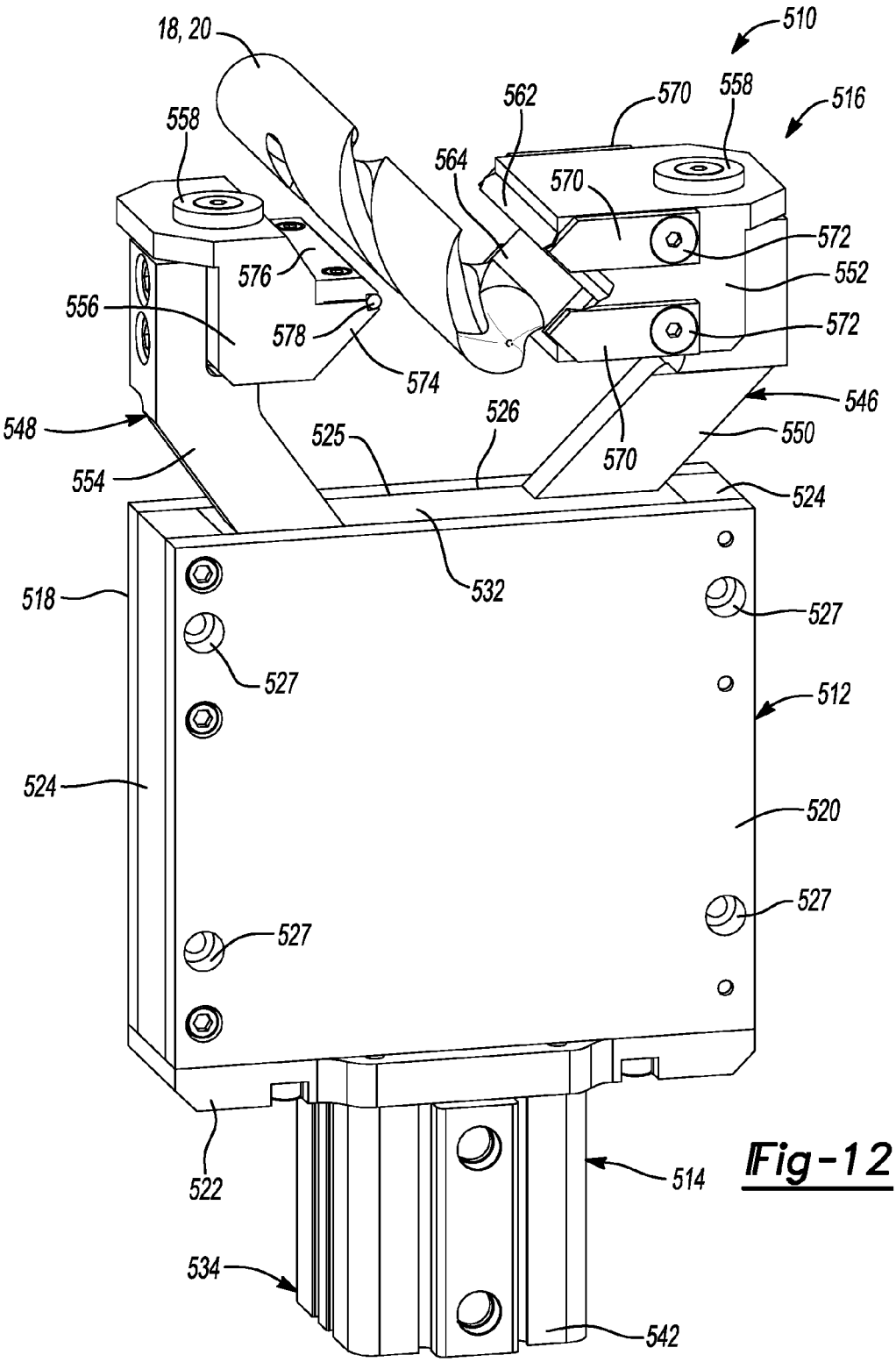
FIG. 12 is a perspective view of yet another fixture assembly according to the principles of the present disclosure.
Figure 13:
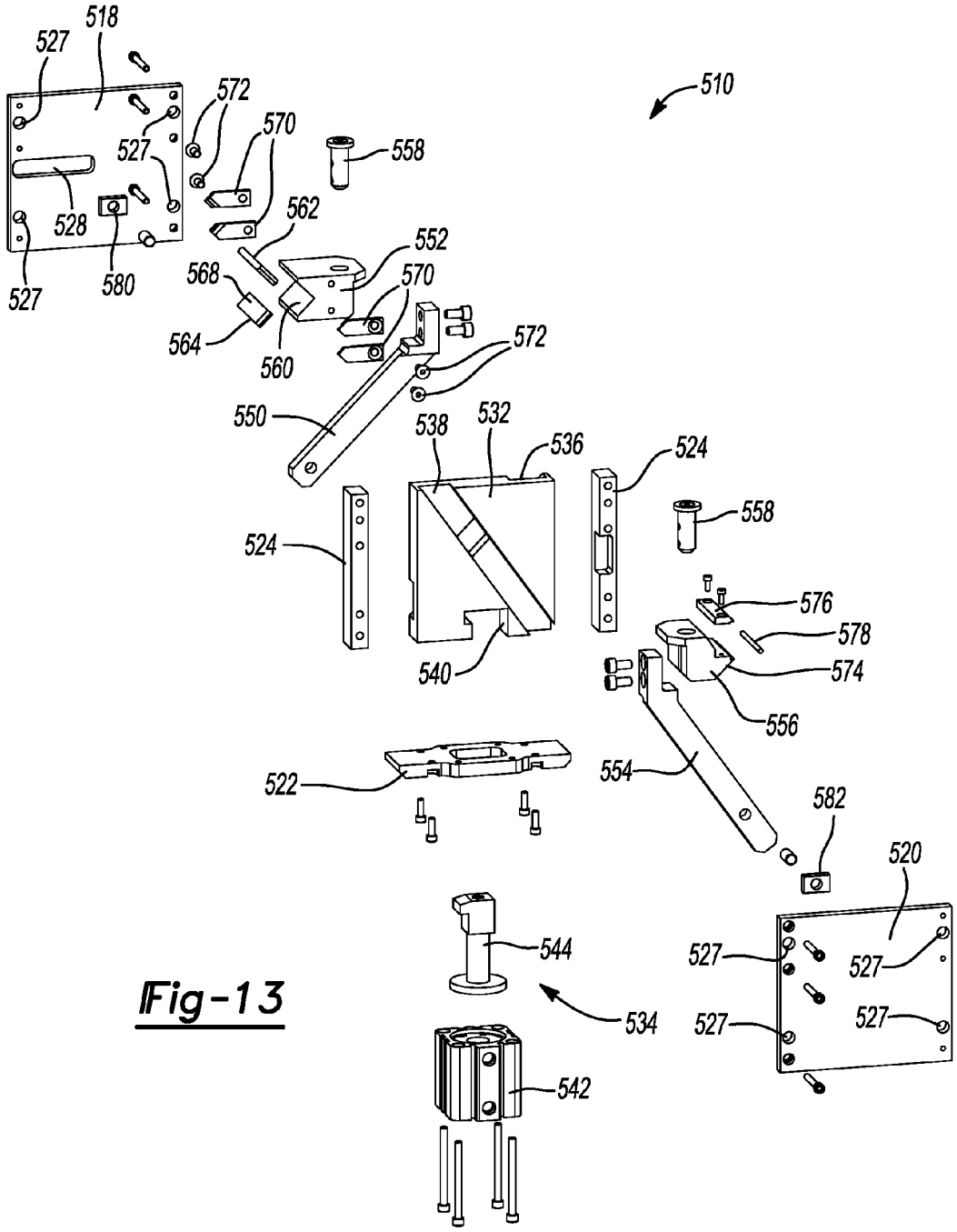
FIG. 13 is an exploded view of the fixture assembly of FIG. 12.

With reference to FIG. 11, another fixture assembly 410 is provided that may include a base (or housing) 412, a clamp assembly 414, and a drive mechanism 416. The structure and function of the base 412 and the clamp assembly 414 may be similar or identical to that of the base 12 and the clamp assembly 14 described above, and therefore, will not be described again in detail.

The drive mechanism 416 may include an actuation assembly 470, a first link 472, and a second link 474. The actuation assembly 470 may include an actuator 476, a first drive block 478, a second drive block 480, and a drive link 482. The structure and function of the actuator 476 can be similar or identical to that of the actuator 70. An output shaft of the actuator 476 may be coupled to the drive link 482 and may move the drive link 482 linearly up and down (relative to the frame of reference of FIG. 11).

The first and second drive blocks 478, 480 may be similar to first and second slide blocks 430, 431 (which may be similar or identical to slide blocks 30, 31) of the first and second clamp member 426, 428. The drive blocks 478, 480 and the slide blocks 430, 431 are slidable along a track 424 mounted to the base 412. One end of the first link 472 may engage the first drive block 478 and the other end of the first link 472 may engage the first slide block 430 such that the first drive block 478 and the first slide block 430 move together along the track 424. One end of the second link 474 may engage the second drive block 480 and the other end of the second link 474 may engage the second slide block 431 such that the second drive block 480 and the second slide block 431 move together along the track 424.

The first and second drive blocks 478, 480 may include first and second guide plates 484, 486, respectively. The first and second guide plates 484, 486 may include first and second slots 490, 492, respectively. The drive link 482 may slidably engage both of the slots 490, 492. The first slot 490 is angled relative to the track 424 (i.e., angled relative to the directions in which the drive blocks 478, 480 slide along the track 424) such that the first slot 490 extends vertically upward as the first slot 490 extends horizontally toward the first and second clamp members 426, 428. The second slot 492 is angled relative to the track 424 (i.e., angled relative to the directions in which the drive blocks 478, 480 slide along the track 424) such that the second slot 492 extends vertically downward as the second slot 492 extends horizontally toward the first and second clamp members 426, 428. The angle of the second slot 492 relative to the track 424 is a steeper angle than the angle of the first slot 490 relative to the track 424.

The actuator 476 can be operated to move the drive link 482 vertically up and down (i.e., toward and away from the track 424). Movement of the drive link 482 causes the drive blocks 478, 480 (and thus, the clamp members 426, 428) to move in opposite directions as the drive link 482 slides along the slots 490, 492. That is, linear downward movement of the drive link 482 causes the first drive block 478 to move along the track 424 away from the second clamp member 428 and causes the second drive block 480 to move along the track toward the first clamp member 426, which moves the first and second clamp members 426, 428 away from each other. Linear upward movement of the drive link 482 causes the first drive block 478 to move along the track 424 toward the second clamp member 428 and causes the second drive block 480 to move along the track away from the first clamp member 426, which moves the first and second clamp members 426, 428 toward each other.

Since the angle of the second slot 492 relative to the track 424 is a steeper angle than the angle of the first slot 490 relative to the track 424, upward and downward movement of the drive link 482 along the slots 490, 492 causes the first drive block 478 (and thus, the first clamp member 426) to move at a faster speed along the track 424 than the second drive block 480 (and thus, the second clamp member 428). Therefore, like the fixture assembly 10, the fixture assembly 410 can clamp drill bits of various diameters at the same predetermined location relative to the base 412, as described above.

Referring now to FIGS. 12-21, another fixture assembly 510 is provided that can clamp drill bits of various diameters at the same predetermined location relative to the housing 512, as described above. That is, the fixture assembly 510 can hold drill bits (or other tools or workpieces) of different diameters without having to realign the fixture assembly 510 relative to a drill-bit-sharpening tool (not show) for each drill bit diameter. That is, the fixture assembly 510 can clamp the first drill bit 18 having a first diameter for a sharpening operation before and/or after clamping the second drill bit 20 having a second diameter that is different than the first diameter for a drill bit sharpening operation without having to realign the fixture assembly 510 relative to the sharpening tool to account for the difference between the first and second diameters, as described above. When the first drill 18 is clamped in the fixture assembly 510, the longitudinal centerline of the first drill bit 18 is in the same location relative to the housing 512 (and the sharpening tool) as the longitudinal centerline of the second drill bit 20 when the second drill bit 20 is clamped in the fixture assembly 510.

Figure 14:
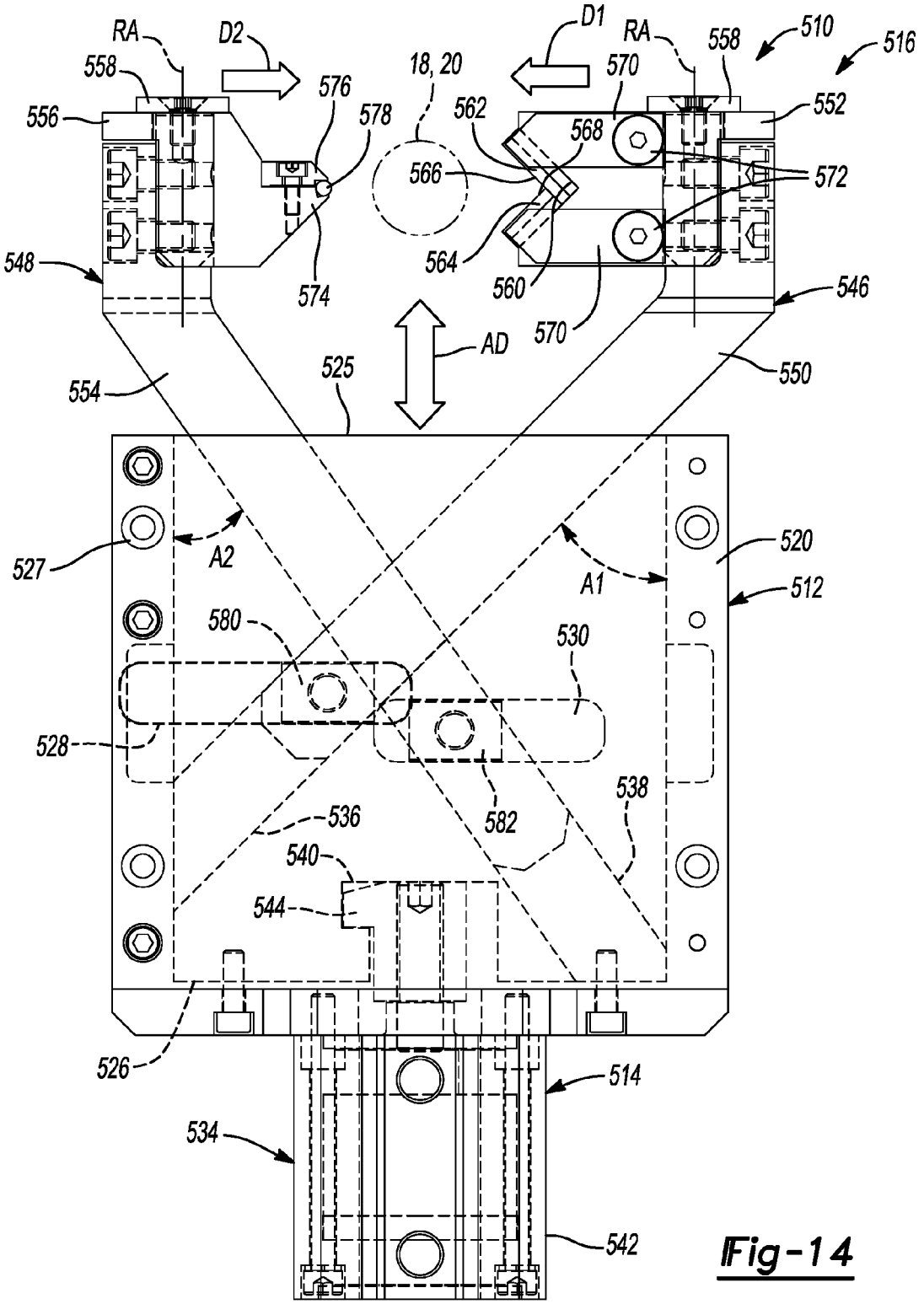
FIG. 14 is a plan view of a drill bit and the fixture assembly in a fully open (unclamped) position.
Figure 15:
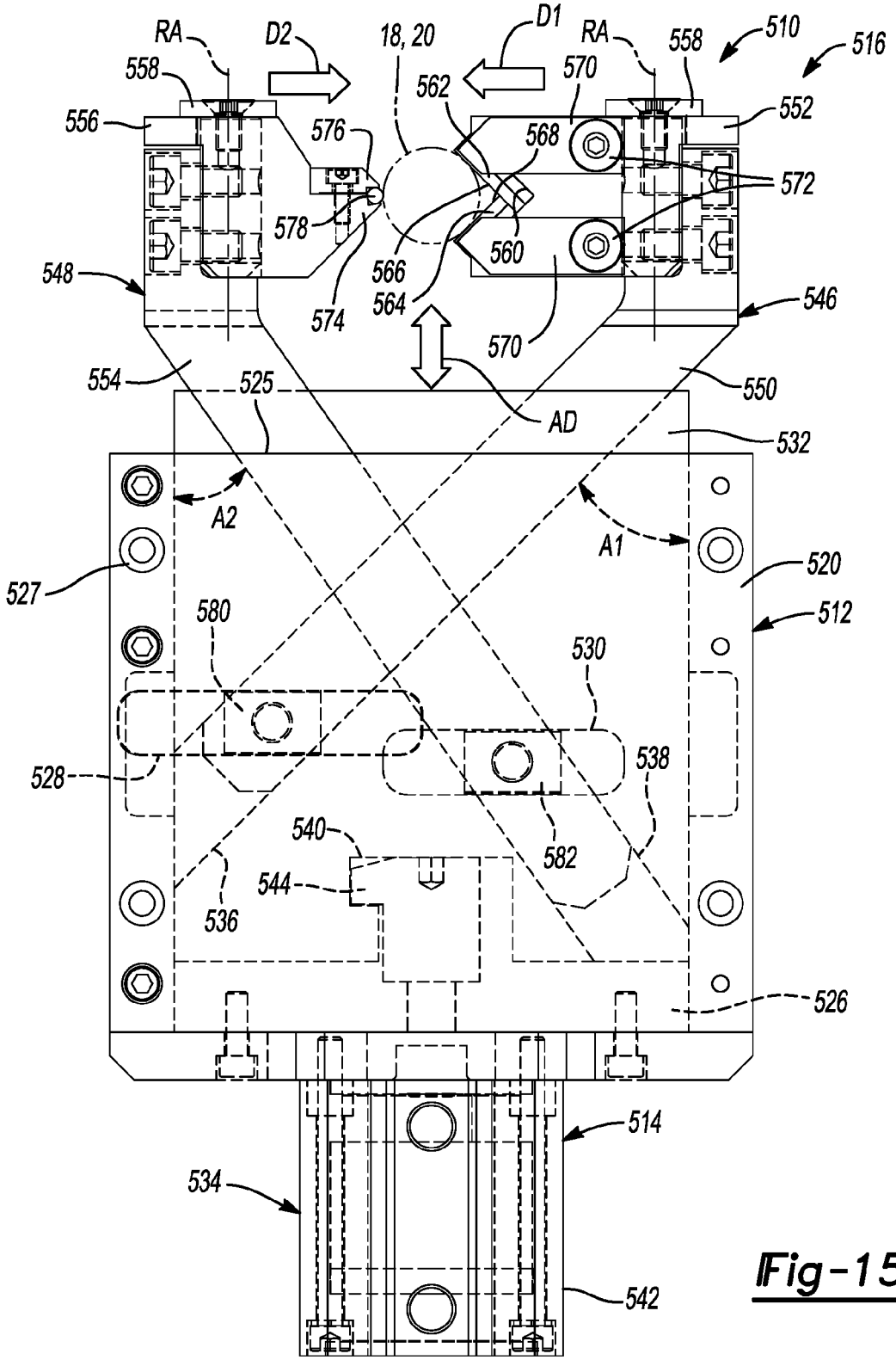
FIG. 15 is a plan view of the drill bit and the fixture assembly of FIG. 12 in a partially closed position and clamping the drill bit.
Figure 16:
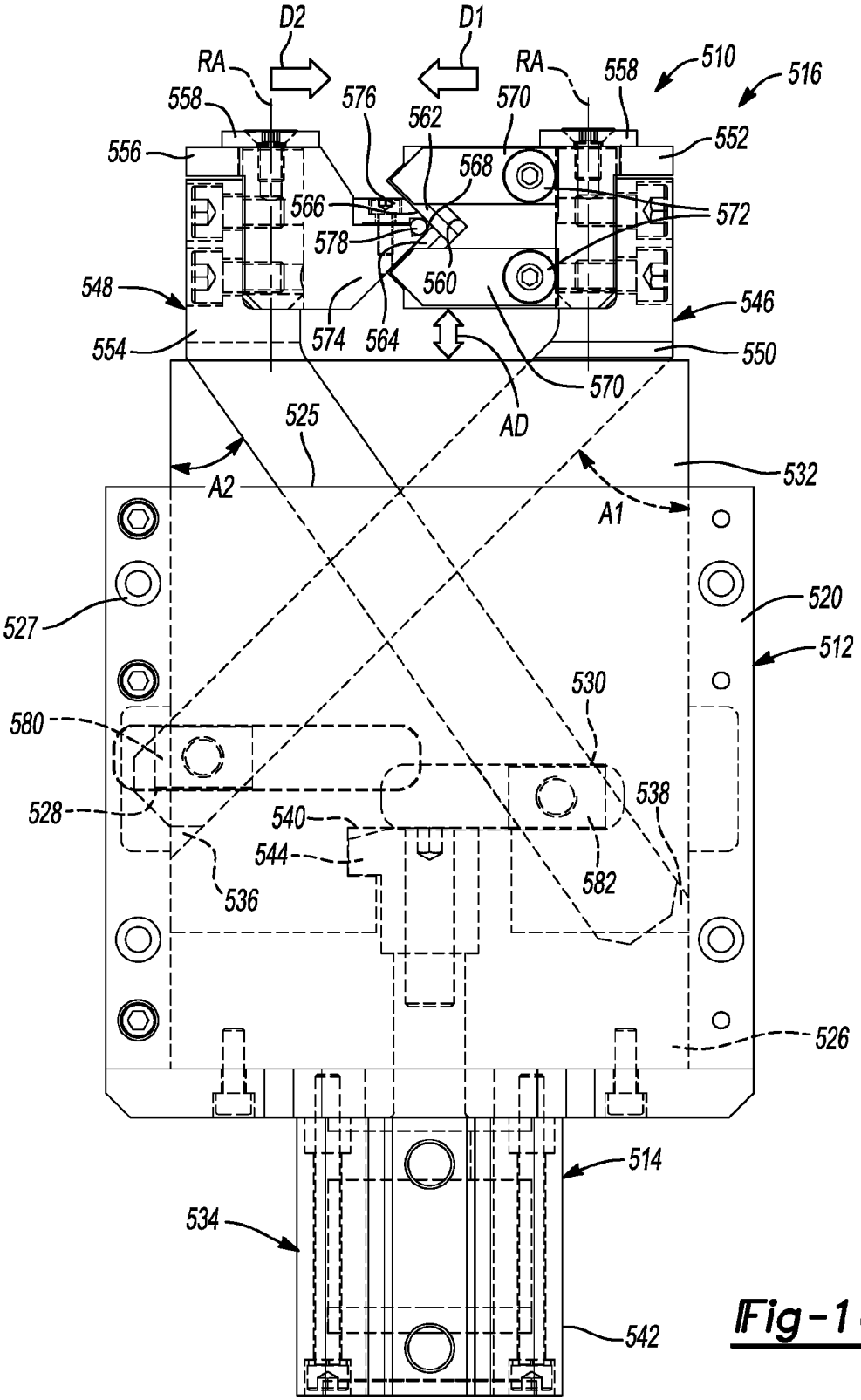
FIG. 16 is a plan view of the fixture assembly of FIG. 12 in a fully closed position.
Figure 18:
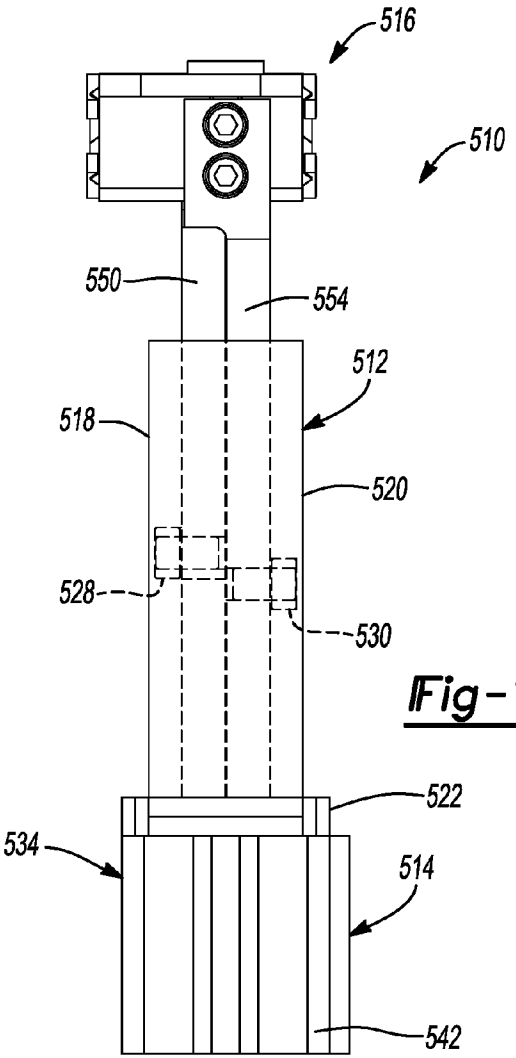
FIG. 18 is a side view of the fixture assembly of FIG. 12.
Figure 21:
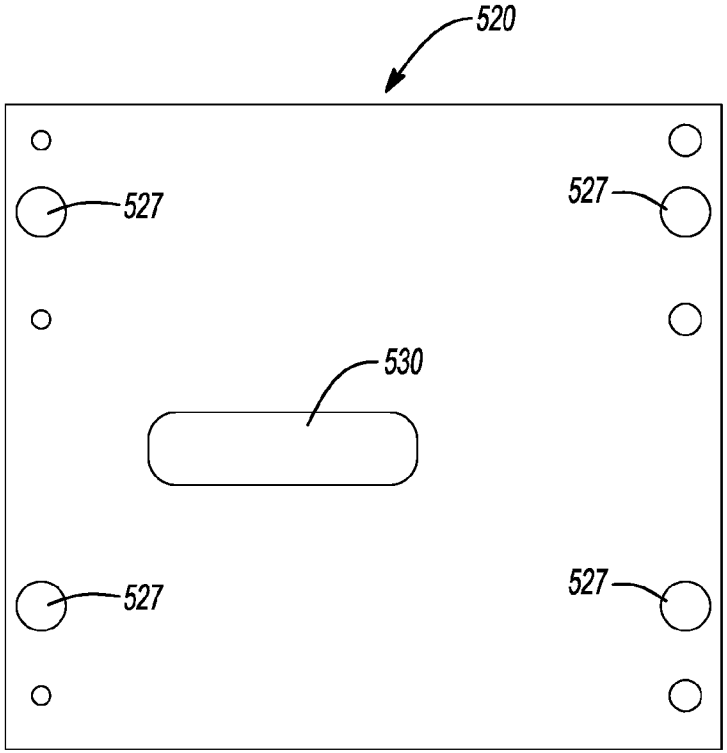
FIG. 21 is a plan view of another outer plate of the fixture assembly of FIG. 12.
Figure 20:
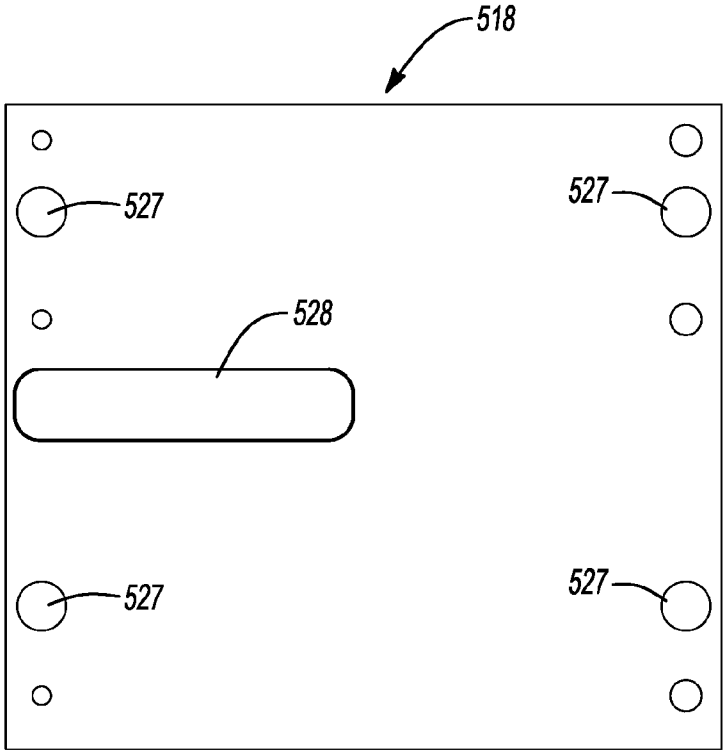
FIG. 20 is a plan view of an outer plate of the fixture assembly of FIG. 12.

The fixture assembly 510 may include a housing (or base) 512, a drive mechanism 514, and a clamp assembly 516. The housing 512 may include a first outer plate 518, a second outer plate 520, an end plate 522, and a pair of side plates 524. The plates 518, 520, 522, 524 cooperate to define a cavity 526 having an opening 525. The plates 518, 520, 522, 524 may be fixedly attached to each other by fasteners, for example. In some configurations, one or more of the plates 518, 520, 522, 524 could be integrally formed with another one or more of the plates 518, 520, 522, 524. One or more of the plates 518, 520, 522, 524 may include mounting apertures 527 for mounting the fixture assembly 510 to a drill bit sharpening tool (not shown), for example. As shown in FIG. 20, the first outer plate 518 may include a first guide slot 528. As shown in FIG. 21, the second outer plate 520 may include a second guide slot 530. As shown in FIGS. 14-16, the first and second guide slots 528, 530 extend in directions that are parallel to each other (i.e., longitudinal axes of the guide slots 528, 530 are parallel to each other). The first and second guide slots 528, 530 are formed in surfaces of the first and second outer plates 518, 520 that face each other and define the cavity 526.

Figure 19:
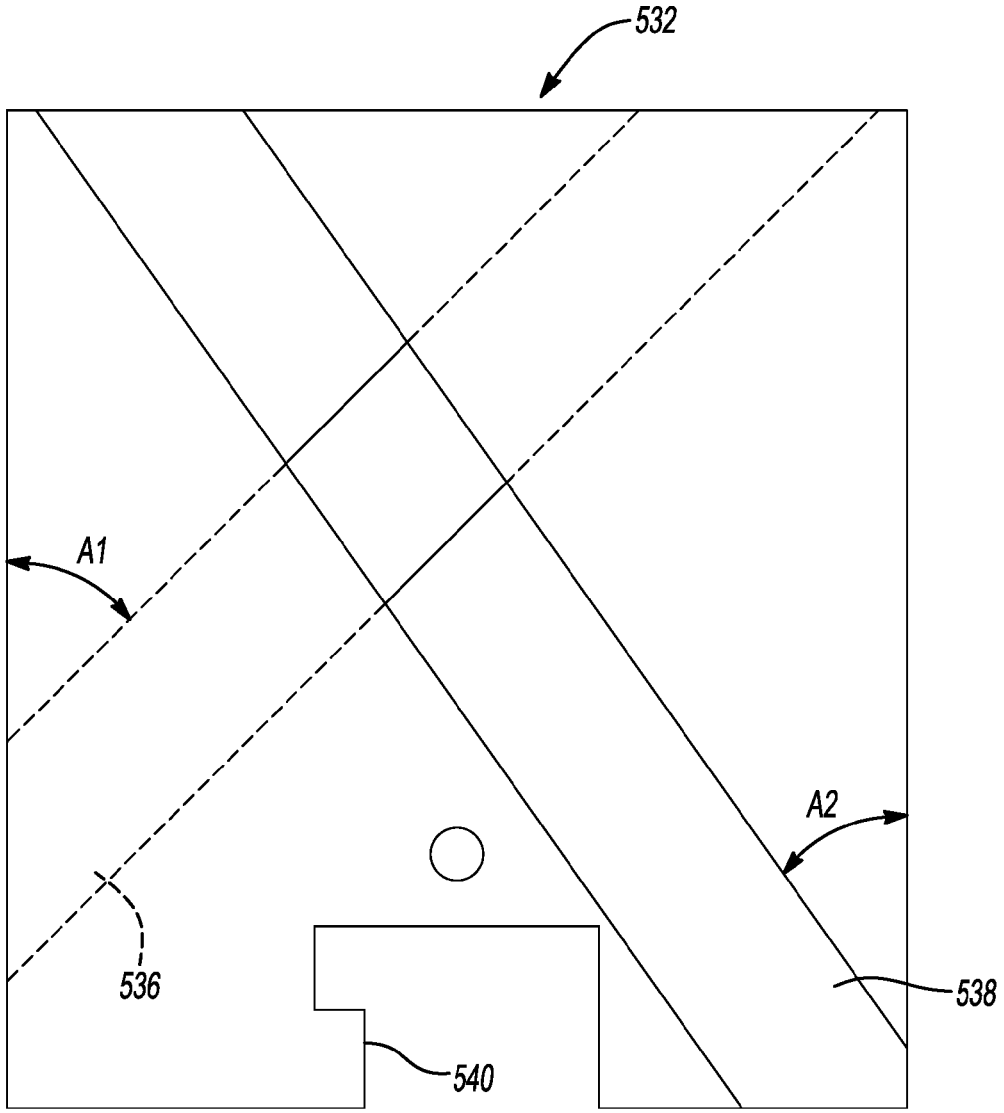
FIG. 19 is a plan view of a central plate of the fixture assembly of FIG. 12.

The drive mechanism 514 may include a central plate 532 and an actuator 534 drivingly connected to the central plate 532. The central plate 532 may be slidably received in the cavity 526 of the housing 512 and may include a first clamp slot 536 and a second clamp slot 538 (see FIGS. 14-16 and 19). As shown in FIG. 19, the first and second clamp slots 536, 538 are formed in opposite sides of the central plate 532. That is, the first clamp slot 536 is formed in a first side of the central plate 532 that faces the first outer plate 518, and the second clamp slot 538 is formed in a second side of the central plate 532 that faces the second outer plate 520. The central plate 532 may also include a cutout 540 having an opening that faces the end plate 522.

The actuator 534 can be any suitable type of actuator that can move the central plate 532 within the cavity 526 of the housing 512, as shown in FIGS. 14-16. For example, the actuator 534 could be an electromechanical actuator, a pneumatic actuator, or a hydraulic actuator. The actuator 534 may include an actuator housing 542 and a piston 544. The piston 544 may engage the cutout 540 in the central plate 532 and may extend through an aperture in the end plate 522. The actuator housing 542 could include a hydraulic cylinder containing hydraulic fluid, a pneumatic cylinder containing compressed air, a solenoid, or an electric motor, for example, that may selectively move the piston 544 relative to the housing 512 back and forth in actuation directions AD (FIGS. 14-16). Such movement of the piston 544 drives the central plate 532 in the actuation directions AD relative to the housing 512.

As shown in FIGS. 14-16, the first clamp slot 536 is disposed at a first acute angle A1 relative to the actuation directions AD, and the second clamp slot 538 is disposed at a second acute angle A2 relative to the actuation directions AD. That is, a longitudinal axis of the first clamp slot 536 extends at the first acute angle A1 relative to the actuation directions AD, and a longitudinal axis of the second clamp slot 538 extends at the second acute angle A2 relative to the actuation directions AD. The first acute angle A1 may be different angle than the second acute angle A2. The first acute angle A1 may be a larger angle than the second acute angle A2. For example, the first acute angle A1 may be 45 degrees and the second acute angle A2 may be 35 degrees.

As shown in FIGS. 14-16, the clamp assembly 516 may include a first clamp member 546 and a second clamp member 548 that are movable relative to the housing 512 and each other in first and second opposite directions D1, D2 between a fully open position (FIG. 14) and a fully closed position (FIG. 16). As shown in FIG. 15, the first and second clamp members 546, 548 can clamp the drill bit 18, 20 at any position between the fully open and fully closed positions. The first and second directions D1, D2 are perpendicular to the actuation directions AD.

Figure 17:
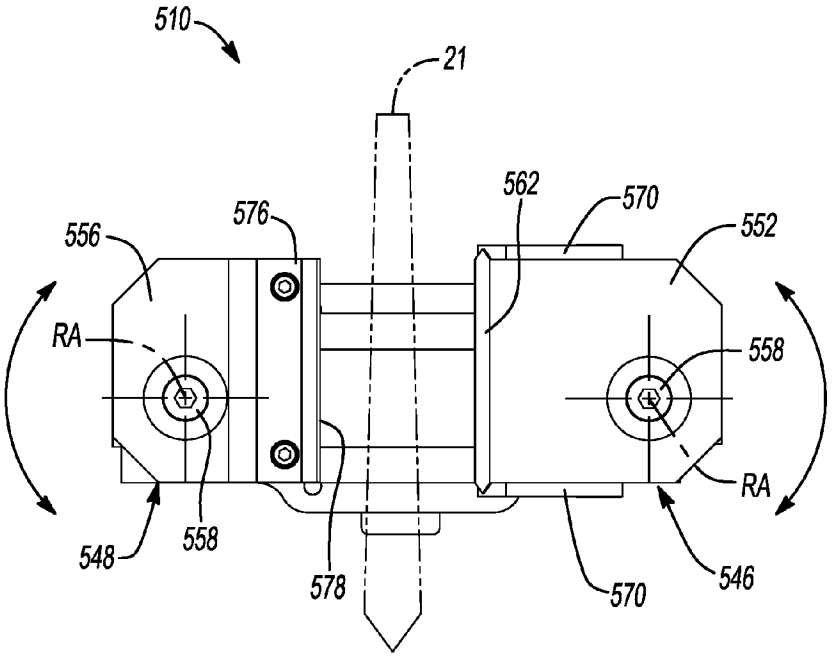
FIG. 17 is a top view of the fixture assembly of FIG. 12 and the drill bit.

The first clamp member 546 may include a first clamp arm 550 and a first clamp block (or gripping block) 552 disposed on an end of the first clamp arm 550. The second clamp member 548 may include a second clamp arm 554 and a second clamp block (or gripping block) 556 disposed on an end of the second clamp arm 554. As shown in FIG. 17, the first clamp block 552 may be fastened to the first clamp arm 550 by a single pin or fastener 558, and the second clamp block 556 may be fastened to the second clamp arm 554 by another single pin or fastener 558. In this manner, the position of the clamp blocks 552, 556 on the clamp arms 550, 554 can be adjusted by rotating the clamp blocks 552, 556 relative to the clamp arms 550, 554 about rotational axes RA (FIG. 14) that are parallel to the actuation directions AD. The rotational axes may be defined by the pins 558. Accordingly, an angle between the first and second clamp blocks 552, 556 can be adjusted to accommodate the tapered drill bit shaft 21 (FIG. 17).

The first clamp block 552 may include a generally V-shaped recess 560. The V-shaped recess 560 may extend laterally through the first clamp block 552 in a direction perpendicular to the first and second directions D1, D2 and perpendicular to the actuation directions AD. First and second gripping pads 562, 564 may be mounted to the first clamp block 552 within the V-shaped recess 560. The gripping pads 562, 564 can be hard, flat blocks that define first and second flat gripping surfaces 566, 568, respectively, that both contact the drill bit 18, 20 when the clamp assembly 516 is clamping the drill bit 18, 20, as shown in FIG. 15.

As shown in FIGS. 14-16, the gripping surfaces 566, 568 are angled relative to each other. In some configurations, the angle between the gripping surfaces 566, 568 is 90 degrees. Each gripping surface 566, 568 may be angled 45 degrees (i.e., half of the angle between the gripping surfaces 566, 568) relative to the first and second directions D1, D2. It will be appreciated that the angle between the gripping surfaces 566, 568 could be more or less than 90 degrees, and the angle between the gripping surfaces 566, 568 and the first and second directions D1, D2 may be more or less than 45 degrees.

As shown in FIGS. 14-17, the gripping pads 562, 564 may be secured to the first clamp block 552 by a plurality of clamps 570 mounted to the first clamp block 552 by fasteners 572. That is, a pair of the clamps 570 contact and clamp against opposing edges of the first gripping pad 562 (as shown in FIG. 17), and another pair of the clamps 570 contact and clamp against opposing edges of the second gripping pad 564. Clamping the gripping pads 562, 564 to the first clamp block 552 may allow for more accurate placement of the gripping pads 562, 564 than other methods of fixing the gripping pads 562, 564 to the first clamp block 552 such as adhesive bonding (since it can be difficult to apply a layer of adhesive having a uniform thickness, and a layer of adhesive having a non-uniform thickness would change the relative angles of the gripping pads 562, 564 relative to each other and relative to the first and second directions D1, D2).

The second clamp block 556 may include a protrusion 574 that extends generally toward the first clamp block 552 and may cooperate with a plate 576 to fixedly engage a hardened cylindrical wear pad (e.g., a cylindrical rod) 578. As shown in FIG. 15, the cylindrical wear pad 578 and the first and second gripping surfaces 566, 568 contact the outer diameter of the drill bit 18, 20 to hold the drill bit 18, 20 in place when the clamp assembly 516 is in the clamped position. An angle between a longitudinal axis of the cylindrical wear pad 578 and an intersection of planes defined by the first and second gripping surfaces 566, 568 can be adjusted by rotating the clamp blocks 552, 556 relative to the clamp arms 550, 554 about rotational axes RA, as described above.

As shown in FIGS. 14-16, the first and second clamp arms 550, 554 of the first and second clamp members 546, 548 may be elongated members that are slidably received in the first and second clamp slots 536, 538, respectively, of the central plate 532. The first clamp arm 550 includes a first slider block 580 attached thereto and extending therefrom. The first slider block 580 is slidably received in the first guide slot 528 formed in the housing 512. The second clamp arm 554 includes a second slider block 582 attached thereto and extending therefrom. The second slider block 582 is slidably received in the second guide slot 530 formed in the housing 512.

The first and second guide slots 528, 530 are perpendicular to the actuation directions AD (i.e., longitudinal axes of the guide slots 528, 530 are perpendicular to the actuation directions AD and parallel to each other and the first and second directions D1, D2). Therefore, as shown in FIGS. 14-16, when the drive mechanism 514 causes the central plate 532 to move relative to the housing 512 in one of the actuation directions AD, the slider blocks 580, 582 move linearly along the guide slots 528, 530 in the first and second opposite directions D1, D2, thereby causing the first and second clamp members 546, 548 to slide within the clamp slots 536, 538 and move linearly relative to the housing 512 toward each other or away from each other in the first and second directions D1, D2. That is, when the central plate 532 moves away from the end plate 522, the slider blocks 580, 582 move away from each other in the first and second directions D1, D2 along their respective guide slots 528, 530 and the clamp blocks 552, 556 move toward each other in the first and second directions D1, D2. When the central plate 532 moves toward the end plate 522, the slider blocks 580, 582 move toward each other in the first and second directions D1, D2 along their respective guide slots 528, 530 and the clamp blocks 552, 556 move away from each other in the first and second directions D1, D2.

Since the first clamp slot 536 is disposed at a larger angle (i.e., the first acute angle A1) relative to the actuation directions AD than the angle at which the second clamp slot 538 is disposed (i.e., the second acute angle A2), movement of the central plate 532 in the actuation directions AD will cause the first clamp block 552 to move linearly relative to the housing 512 at a first speed that is faster than a second speed at which the second clamp block 556 will move linearly relative to the housing 512.

The predetermined difference or proportionality between the first and second speeds will cause the first and second clamp blocks 552, 556 to clamp the first drill bit 18 at a location such that the longitudinal center C1 of the first drill bit 18 is positioned at a predetermined location relative to the housing 512 and will also cause the first and second clamp blocks 552, 556 to clamp the second drill bit 20 (which has a diameter that is larger than a diameter of the first drill bit 18) a location such that the longitudinal center C2 of the second drill bit 20 is also positioned at the same predetermined location relative to the housing 512, as shown in FIG. 6 and described above with reference to the fixture assembly 10. In other words, the predetermined difference or proportionality between the first and second speeds will cause the first and second clamp blocks 552, 556 to clamp any drill bit having any size diameter at the same predetermined location relative to the housing 512 without making any adjustments to the positions of the gripping surfaces 566, 568 relative to the first clamp block 552 or any adjustments of the position of the cylindrical wear pad 578 relative to the second clamp block 556.

The first and second clamp blocks 552, 556 move at different speeds because they move different distances to clamp a drill bit at the predetermined location relative to the housing 512. As shown in FIG. 6 with reference to the fixture assembly 10, when the first drill bit 18 is clamped in the clamp assembly 516, a given point on the first clamp member 546 is disposed at a first distance D1 from the center C1 of the first drill bit 18 (the center C1 is at the predetermined location relative to the housing 512) and a given point on the second clamp member 548 is disposed a second distance D2 from the center C1. When the second drill bit 20 is clamped in the clamp assembly 516, the given point on the first clamp member 546 is disposed at a third distance D3 from the center C2 of the second drill bit 20 (the center C2 is at the predetermined location relative to the housing 512) and the given point on the second clamp member 548 is disposed a fourth distance D4 from the center C2. The difference between the third and first distances D3, D1 is greater than the difference between the fourth and second distances D4, D2. Therefore, the drive mechanism 514 moves the first clamp member 546 at a faster speed than the second clamp member 548 so that the first and second clamp members 546, 548 will both come into contact with the outer diameter of the drill bit at the same time and at locations at which the center of the drill bit will be at the predetermined location relative the housing 512, regardless of the size of the diameter of the drill bit.

The ability of the fixture assembly 510 to clamp any drill bit having any size diameter (within the range or capacity of a given fixture assembly 510) at the same predetermined location relative to the housing 512 eliminates the need for a user to realign the fixture assembly 510 relative to a drill bit sharpening tool for drill bits of different diameters. Such capability can save substantial amounts of time, money and resources for a user that is sharpening many drill bits of various diameters.

The configuration of the first and second clamp blocks 552, 556 described above (i.e., the first clamp block 552 having the gripping pads 562, 564 that cooperate to form a V-shape, and the second clamp block 556 having the cylindrical wear pad 578) and the manner in which the first and second clamp blocks 552, 556 grip the drill bit 18, 20 (i.e., the gripping pads 562, 564 and wear pad 578 cooperate to grip the drill bit 18, 20 at three locations) allow the fixture assembly 510 to grip drill bits (or other workpieces) of a wider range of diameters relative to other prior-art fixture assemblies. For example, unlike the fixture assemblies 10, 210, 310, 410, 510 of the present disclosure, a fixture assembly that grips a drill bit (or other workpiece) using two V-shaped grippers (such as the fixture assembly disclosed in U.S. Pat. No. 4,647,097) or three flat grippers (such as the fixture assembly disclosed in U.S. Pat. No. 4,399,639) cannot grip very small-diameter workpieces. That is, when a fixture assembly that grips a workpiece using two V-shaped grippers or three flat grippers is in a fully closed position (i.e., where the two V-shaped grippers are in contact with each other or where the three flat grippers are in contact with each other), very small-diameter workpieces cannot be gripped by these grippers. On the other hand, when the fixture assemblies 10, 210, 310, 410, 510 of the present disclosure are in the fully closed position (as shown in FIG. 16, for example), the cylindrical wear pad 578 and the gripping pads 562, 564 are able to securely grip very small-diameter workpieces since the cylindrical wear pad 578 is able to get much closer to the intersection of the gripping pads 562, 564. This configuration of the fixture assemblies 10, 210, 310, 410, 510 also allows for gripping of very large-diameter workpieces.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fixture assembly comprising:

a housing;

a clamp assembly movably mounted to the housing and including a first clamp member and a second clamp member, the first and second clamp members are linearly movable relative to the housing toward and away from each other; and a drive mechanism coupled to the clamp assembly and the housing and driving the clamp assembly relative to the housing such that the first clamp member moves linearly toward the second clamp member at a first speed in a first direction and the second clamp member moves linearly toward the first clamp member at a second speed in a second direction that is opposite the first direction, and wherein the first speed is different than the second speed.

2. The fixture assembly of claim 1, wherein the drive mechanism includes a central plate that engages the first and second clamp members, the central plate is received in the housing and is slidable within the housing in a third direction that is perpendicular to the first and second directions.

3. The fixture assembly of claim 2, wherein the central plate includes a first side having a first clamp slot formed therein and a second side having a second clamp slot formed therein, the first and second sides are opposite each other, and wherein the first clamp member is slidably received in the first clamp slot and the second clamp member is slidably received in the second clamp slot.

4. The fixture assembly of claim 3, wherein the first and second clamp slots are disposed at acute angles relative to the third direction.

5. The fixture assembly of claim 4, wherein the first clamp slot is disposed at a first acute angle relative to the third direction, and the second clamp slot is disposed at a second acute angle relative to the third direction, wherein the first acute angle is different than the second acute angle.

6. The fixture assembly of claim 5, wherein the housing includes a first guide slot and a second guide slot, the first guide slot slidably receives a first slider block attached to the first clamp member, the second guide slot slidably receives a second slider block attached to the second clamp member, wherein the first slider block moves within the second guide slot in the first direction as the central plate moves in the third direction, and wherein the second slider block moves within the second guide slot in the second direction as the central plate moves in the third direction.

7. The fixture assembly of claim 6, wherein the first clamp member includes a first flat gripping surface and a second flat gripping surface that is angled relative to the first flat gripping surface, wherein the first and second flat gripping surfaces both engage a workpiece and cooperate with the second clamp member to fix the workpiece relative to the housing.

8. The fixture assembly of claim 7, wherein an angle between the first flat gripping surface and the second direction is equal to the first angle, wherein an angle between the second flat gripping surface and the second direction is equal to the first angle, and wherein the second angle is less than the first angle.

9. The fixture assembly of claim 8, wherein the second clamp member includes cylindrical rod having a longitudinal axis that is perpendicular to the third direction.

10. The fixture assembly of claim 9, wherein the first clamp member includes a first clamp arm and a first clamp block, the first clamp arm is slidably received in the first clamp slot in the central plate, the first clamp block is mounted to an end of the first clamp arm and is pivotable relative to the first clamp arm about a first rotational axis that is parallel to the third direction, and wherein the first and second flat gripping surfaces are mounted on the first clamp block.

11. The fixture assembly of claim 10, wherein the second clamp member includes a second clamp arm and a second clamp block, the second clamp arm is slidably received in the second clamp slot in the central plate, the second clamp block is mounted to an end of the second clamp arm and is pivotable relative to the second clamp arm about a second rotational axis that is parallel to the third direction, and wherein the cylindrical rod is mounted on the second clamp block.

12. The fixture assembly of claim 11, wherein the first and second flat gripping surfaces are defined by first and second wear pads, respectively, that are mounted to the first clamp block, wherein edges of the first wear pad are clamped to fix the first wear pad to the first clamp block, and wherein edges of the second wear pad are clamped to fix the second wear pad to the first clamp block.

13. A method of clamping a first tool and a second tool in a fixture assembly including a housing, a first clamp member and a second clamp member, the first and second tools having different outer diameters, the method comprising:

driving the first and second clamp members relative to the housing and toward each other to clamp the first tool therebetween such that a centerline of the first tool is disposed at a given location relative to the housing;

unclamping the first tool; and driving the first and second clamp members relative to the housing and toward each other to clamp the second tool therebetween such that a centerline of the second tool is disposed at the given location relative to the housing, wherein the first clamp member is disposed a first distance from the given location while the first tool is clamped between the first and second clamp members, and the second clamp member is disposed a second distance from the given location while the first tool is clamped between the first and second clamp members, wherein the first clamp member is disposed a third distance from the given location while the second tool is clamped between the first and second clamp members, and the second clamp member is disposed a fourth distance from the given location while the second tool is clamped between the first and second clamp members, and wherein a difference between the third and first distances is different than a difference between the fourth and second distances.

14. The method of claim 13, wherein driving the first and second clamp members toward each other includes driving the first clamp member at a first speed while simultaneously driving the second clamp member at a second speed that is different from the first speed.

15. The method of claim 14, wherein driving the first and second clamp members toward each other includes driving the first and second clamp members in opposite linear directions.

16. The method of claim 15, wherein driving the first and second clamp members toward each other includes moving a plate within the housing in a direction perpendicular to the directions in which the first and second clamp members move toward each other, wherein the plate includes a first clamp slot that slidably receives the first clamp and a second clamp slot that slidably receives the second clamp, and wherein the first clamp slot is disposed at a first acute angle relative to the direction in which the plate moves within the housing, and the second clamp slot is disposed at a second acute angle relative to the direction in which the plate moves within the housing, wherein the first acute angle is different than the second acute angle.

17. The method of claim 13, wherein the first clamp member includes first and second flat gripping surfaces that are disposed at an angle relative to each other, wherein clamping the first tool includes contacting the first tool with the first and second flat gripping surfaces, and wherein clamping the second tool includes contacting the second tool with the first and second flat gripping surfaces.

18. The method of claim 17, wherein the second clamp member includes a cylindrical rod, and wherein clamping the first tool includes contacting the first tool with the cylindrical rod, and wherein clamping the second tool includes contacting the second tool with the cylindrical rod.

19. The method of claim 13, further comprising adjusting an angle between a longitudinal axis of the cylindrical rod and an intersection of planes defining the first and second flat gripping surfaces.

20. The method of claim 13, wherein the first and second tools are drill bits.

* * * * *